US009339722B2

(12) United States Patent
Toshima et al.

(10) Patent No.: US 9,339,722 B2
(45) Date of Patent: May 17, 2016

(54) GAME DEVICE

(75) Inventors: Takahiro Toshima, Yokohama (JP); Yasushi Funayama, Chiba (JP); Hirokazu Hirose, Akashi (JP)

(73) Assignee: Bandai Namco Entertainment Inc., Tokyo (JP)

( * ) Notice: Subject to any disclaimer, the term of this patent is extended or adjusted under 35 U.S.C. 154(b) by 361 days.

(21) Appl. No.: 13/821,451

(22) PCT Filed: Jul. 29, 2011

(86) PCT No.: PCT/JP2011/067423

§ 371 (c)(1),
(2), (4) Date: May 8, 2013

(87) PCT Pub. No.: WO2012/032875

PCT Pub. Date: Mar. 15, 2012

(65) Prior Publication Data

US 2013/0221614 A1 Aug. 29, 2013

(30) Foreign Application Priority Data

Sep. 8, 2010 (JP) ..... 2010-201175

(51) Int. Cl.
*A63F 7/00* (2006.01)
*A63F 7/06* (2006.01)
(Continued)

(52) U.S. Cl.
CPC ..... *A63F 7/0005* (2013.01); *A63F 7/0636* (2013.01); *A63F 7/3603* (2013.01); *A63F 2007/4018* (2013.01)

(58) Field of Classification Search
CPC ..... A63F 7/22; A63F 7/00; A63F 7/0636; A63F 2007/4018; A63F 7/0005; A63F 7/3603
USPC ..... 273/108, 108.1, 126 R, 126 A, 121 A, 273/121 D, 122 A, 108.56, 120 R, 120 A
See application file for complete search history.

(56) References Cited

U.S. PATENT DOCUMENTS 2,753,187 A * 7/1956 Orsini ..... A63F 7/0076 273/120 R
3,033,570 A * 5/1962 Mathes ..... A63F 7/0017 273/120 R (Continued)

FOREIGN PATENT DOCUMENTS

CN 1181712 A 5/1998
CN 1802190 A 7/2006

(Continued)

OTHER PUBLICATIONS

Sep. 1, 2010 Extract of the Liberty Game Website. Majestic Leisure Ltd. t/a Liberty Games, London, United Kingdom. <http://web.archive.org/web/20100901200239/http://www.libertygames.co.uk/store/air_hockey_tables/air-hockey-accessories-pucks-pushers/>.

(Continued)

*Primary Examiner* — Sebastiano Passaniti
(74) *Attorney, Agent, or Firm* — Oliff PLC

(57) ABSTRACT

An air hockey game device allows a plurality of players to play a match game using a first puck and a second puck having a disc size smaller than that of the first puck. The air hockey game device is configured so that each player can score points by shooting the first puck and the second puck into the opponent's goal. The air hockey game device is configured to control the game process (e.g., collection/supply of the first puck and the second puck, calculation/display of score, and production effect) based on the type of puck.

9 Claims, 16 Drawing Sheets

(51) Int. Cl.

| | |
|---|---|
| ***A63F 7/07*** | (2006.01) |
| *A63F 7/36* | (2006.01) |
| *A63F 7/40* | (2006.01) |

(56) References Cited

U.S. PATENT DOCUMENTS

| | | | | |
|---|---|---|---|---|
| 3,174,752 | A * | 3/1965 | Plentis | A63F 7/0005 273/126 R |
| 3,219,349 | A * | 11/1965 | Smith | A63F 7/0005 273/126 R |
| 3,460,833 | A * | 8/1969 | Killoren | A63F 7/0017 273/120 R |
| 3,643,951 | A * | 2/1972 | Breslow | A63F 7/02 273/108 |
| 3,807,738 | A * | 4/1974 | Breslow | A63F 9/02 273/120 R |
| 3,907,294 | A * | 9/1975 | Breslow | A63F 7/0005 273/108.1 |
| 4,032,150 | A | 6/1977 | Wilson | |
| 4,061,334 | A * | 12/1977 | Kanno | A63F 9/02 273/109 |
| 4,872,679 | A * | 10/1989 | Bohaski et al. | 273/317.5 |
| 5,785,313 | A * | 7/1998 | Shiraishi | 273/108.1 |
| 5,788,231 | A * | 8/1998 | To | 273/126 R |
| 5,931,465 | A | 8/1999 | Miyake et al. | |
| 6,234,476 | B1 * | 5/2001 | Yamashita | A63F 7/3603 273/126 A |
| 6,276,682 | B1 | 8/2001 | Yamashita et al. | |
| 6,843,723 | B2 | 1/2005 | Joshi | |
| 6,939,226 | B1 | 9/2005 | Joshi | |
| 6,960,136 | B2 | 11/2005 | Joshi et al. | |
| 6,974,385 | B2 | 12/2005 | Joshi et al. | |
| 6,991,543 | B2 | 1/2006 | Joshi | |
| 7,364,508 | B2 | 4/2008 | Loose et al. | |
| 7,479,063 | B2 | 1/2009 | Pryzby et al. | |
| 7,666,091 | B2 | 2/2010 | Joshi et al. | |
| 7,867,085 | B2 | 1/2011 | Pryzby et al. | |
| 7,934,989 | B2 | 5/2011 | Joshi et al. | |
| 8,147,323 | B2 | 4/2012 | Joshi et al. | |
| 2003/0047868 | A1 * | 3/2003 | Jenkins | A63F 7/06 273/108.57 |
| 2003/0100359 | A1 | 5/2003 | Loose et al. | |
| 2008/0176654 | A1 | 7/2008 | Loose et al. | |
| 2011/0244960 | A1 | 10/2011 | Joshi et al. | |

FOREIGN PATENT DOCUMENTS

| | | | |
|---|---|---|---|
| GB | 1295929 | A | 11/1972 |
| JP | H07-51465 | A | 2/1995 |
| JP | A-7-124280 | | 5/1995 |
| JP | A-07-194838 | | 8/1995 |
| JP | A-08-299584 | | 11/1996 |
| JP | A-09-239144 | | 9/1997 |
| JP | A-9-322978 | | 12/1997 |
| JP | A-10-146458 | | 6/1998 |
| JP | 2000-210465 | A | 8/2000 |
| JP | A-2004-216161 | | 8/2004 |
| JP | A-2006-223604 | | 8/2006 |
| JP | 2008-000323 | A | 1/2008 |
| JP | 2011-120826 | A | 6/2011 |
| WO | 2004-108235 | A2 | 12/2004 |

OTHER PUBLICATIONS

Oct. 4, 2011 International Search Report issued in International Application No. PCT/JP2011/067423.

Oct. 4, 2011 Written Opinion of the International Searching Authority issued in International Application No. PCT/JP2011/067423.

May 1, 2015 Office Action issued in United Kingdom Patent Application No. 1420625.4.

Nov. 25, 2010 "Hockey Stadium," The types of Air Hockey, URL: http://airhockey.web.fc2.com/syurui.html.

Sep. 2011 "Heat Up Hockey Image," URL: http://img.am-net-bbs.com/show/am2009/huhimage.jpg.

* cited by examiner

GAME DEVICE

TECHNICAL FIELD

The present invention relates to a game device that allows a plurality of players to compete for the score by shooting a game medium (e.g., disc-like puck) that floats over the surface of a field into the opponent's goal.

BACKGROUND ART

An air hockey game device has been known as an arcade game device that allows a plurality of players to experience excitement and exhilaration by shooting a puck that slides on the surface of a field at a high speed into the opponent's goal.

The air hockey game device may include a field board that has a plurality of air holes, and allows a disc-like puck to slide in a floating state, a blower unit that supplies air to each air hole, a wall member that is provided around the surface of the field, and changes the slide direction of the puck, and a goal pocket (target) that is provided in the field board (see JP-A-8-299584, for example).

SUMMARY OF INVENTION

Technical Problem

However, a game device such as the air hockey game device disclosed in JP-A-8-299584 is normally configured so that an expected result is obtained when the difference in skill between the players is large.

An air hockey game device may be configured so that the difficulty level of the game is increased by simultaneously supplying a plurality of game media during the game. In this case, however, an expected result is also obtained when the difference in skill between the players is large.

A game device that utilizes a plurality of game media does not provide novel game playability, and it is difficult to allow the players to enjoy the game when the difference in skill between the players is large.

The invention was conceived in order to solve the above problems. An object of the invention is to provide a game device that can provide novel game playability, and allows the players to enjoy the game even when the difference in skill between the players is large.

Solution to Problem (1) According to one aspect of the invention, there is provided a game device that implements a game that allows a plurality of players to strike a game medium using a striking device to shoot the game medium into a goal of an opponent player, the game device including:

a field board that includes a sliding surface, and a wall member that is provided around the sliding surface, the game medium sliding on the sliding surface;

a plurality of goal pockets that functions as the goal, each of the plurality of goal pockets including an opening that is formed in the field board, and receiving the game medium;

a supply unit that supplies a first game medium and a second game medium to the field board corresponding to a game situation, the second game medium differing in type from the first game medium; and a game control unit that controls the supply unit to selectively supply at least one of the first game medium and the second game medium, and controls a process of the game corresponding to the type of game medium supplied.

The slide speed of the game medium differs depending on the type (e.g., size (hereinafter may be referred to as "game medium size"), weight, or material) of the game medium even when the game medium is struck using an identical striking device at an identical force. For example, a small game medium or a light game medium slides on the surface of the field board at a high speed, and a large game medium or a heavy game medium slides on the surface of the field board at a low speed (i.e., the game medium slides (moves) at a different speed when the game medium is struck).

Since the game device having the above configuration can implement a game (e.g., air hockey game) that utilizes a plurality of game media that differs in type (e.g., game medium size, weight, or material), and allows a plurality of players to strike the game medium into the opponent's goal, it is possible to provide novel game playability by allowing the game media that slide at a different speed to be present on the field board.

Therefore, the game device according to one aspect of the invention can control the process of the game (e.g., changing the score based on the type of game medium, or supplying a game medium that differs from the current game medium to the field when the game is played using the current game medium) based on the type of game medium, can enhance the variation of the game, and can produce an exciting game by changing the game playability.

Since the game device according to one aspect of the invention can attach importance to game strategy rather than a striking device operation skill for controlling a single game medium by allowing a plurality of different game media to be present on the field, and controlling the process of the game based on the type of game medium, it is possible to allow the players to enjoy the game even when the players differ in skill.

(2) In the game device, the supply unit may include a first supply section that slidably supplies the first game medium singly to the field board, and a second supply section that slidably supplies a plurality of the second game media to the field board.

According to the above configuration, since the second game medium can be supplied to the field when the game is played using the first game medium, it is possible to change the game playability during the game to implement an exciting game.

(3) In the game device, the second supply section may slidably supply the plurality of second game media simultaneously to the field board when the game is being played using the first game medium, and a given condition has been satisfied.

According to the above configuration, since a plurality of second game media can be supplied to the field when the game is played using the first game medium, it is possible to change the game playability during the game to implement an exciting game.

(4) In the game device, the second supply section may be formed on a slope member that has a slope that is formed at a given slope angle with respect to a surface of the field board, may retain the plurality of second game media in a state in which the plurality of second game media is placed side by side in a direction that intersects a slope direction of the slope, and may slidably supply the plurality of second game media to the field board by allowing the plurality of second game media retained therein to slide along the slope due to gravity.

According to the above configuration, since the second game media are retained so that the second game media are placed side by side in the direction that intersects the slope direction of the slope, the game medium can be slidably supplied to the field board while preventing a situation in which the game medium that has reached the surface of the field overlaps another game medium.

Specifically, since a plurality of second game media can be supplied while allowing the second game media to slide along the slope, the second game medium appear on the field board in a sliding manner.

This makes it possible to throw the players into a panic, and change the game playability during the game to implement an exciting game.

(5) In the game device, the second supply section may include a supply guide member that is formed integrally with the slope, and slidably supplies the second game medium to the field board while sliding the second game medium, and a supply angle when the second game medium is supplied by the supply guide member may be smaller than the slope angle of the slope.

According to the above configuration, since the angular difference with respect to the surface of the field board in the horizontal direction can be reduced by setting the second game medium supply angle to be smaller than the slope angle of the slope, the second game medium can be horizontally supplied to the surface of the field board. This makes it possible to more reliably slidably supply a plurality of second game media simultaneously to the field board.

(6) In the game device, the second supply section may further include a stopper that is provided at a given position on the slope, the stopper maintaining a retention state of the plurality of second game media in a closed state, and slidably supplying the plurality of second game media to the field board in an open state by allowing the plurality of second game media retained in the second supply section to slide along the slope due to gravity, and the game control unit may set the stopper from the closed state to the open state when a given condition has been satisfied.

According to the above configuration, a plurality of second game media can be simultaneously supplied to the surface of the field board by setting the stopper from the closed state to the open state when a given condition has been satisfied.

The given condition may be (a) a condition whereby one of the players has continuously lost the game, (b) a condition whereby a predetermined difference in score has been reached, or (c) a condition whereby a given time has elapsed (i.e., a condition based on the situation or the process of the game), for example.

The above configuration makes it possible to simplify the structure of the supply unit, and change the game playability during the game to implement an exciting game.

(7) The game device may further include a loading unit that transfers the first game medium and the second game medium that have entered the goal pocket in a mixed state and have been collected under the field board to the supply unit using different elevator mechanisms corresponding to a type of game medium, and loads the first game medium and the second game medium into the supply unit.

According to the above configuration, the collected game medium can be reliably loaded into the supply unit corresponding to the type of game medium, and the loading unit can be used as a mechanism for retaining the game medium by adjusting the moving timing of the elevator mechanism from the position under the field board to the supply unit.

(8) In the game device, the loading unit may include a retention section that selectively retains the second game medium that has been collected together with the first game medium in a mixed state, may supply the collected first game medium to the supply unit using the elevator mechanism, and may supply the retained second game medium to the supply unit using the elevator mechanism.

According to the above configuration, the loading unit itself can be used as a mechanism for retaining the first game medium that is simultaneously used in a small number by adjusting the moving timing of the elevator mechanism from the position under the field board to the supply unit, and the second game medium that is simultaneously used in a large number can be retained using the retention section.

This makes it possible to smoothly collect and load the game media even when a large number of game media are used, and supply a sufficient number of game media to the field board by preventing a short supply to the supply unit.

(9) In the game device, the first game medium and the second game medium may have a disc-like shape.

According to the above configuration, since the game medium has such a shape that force can be easily transmitted when the game medium has been struck, or has collided with the wall member of the field board, the game medium can slide on the field board at a high speed, and the player can experience exhilaration.

(10) The game device may further include a collection/transfer mechanism that collects a plurality of game media that differs in size and has entered the goal pocket in a mixed state, and transfers the plurality of game media that has been collected to the supply unit, the collection/transfer mechanism may include a transfer unit that sequentially transfers the plurality of game media from a first transfer point to a second transfer point that is higher than the first transfer point, and a plurality of protrusion members may be formed at given intervals on an upper side of the transfer unit on which the game medium is placed, the plurality of protrusion members preventing the game medium placed on the upper side of the transfer unit from falling down in an upstream direction, and having a height equal to or larger than a thickness of each of the plurality of game media.

According to the above configuration, the collected game medium can be transferred from a lower position to a higher position. Moreover, since the game medium is not transferred in a state in which a plurality of game media overlaps, the game medium can be transferred separately.

DESCRIPTION OF EMBODIMENTS

A game device according to exemplary embodiments of the invention is described in detail below with reference to the drawings.

The following exemplary embodiments are described taking an example in which the game device is an arcade game device that allows a plurality of players to shoot a disc-like game medium referred to as a puck that slides on a field utilizing air into the opponent's goal using a striking device referred to as a mallet (hereinafter referred to as "air hockey game device").

Schematic Configuration of Air Hockey Game Device

Figure 1:
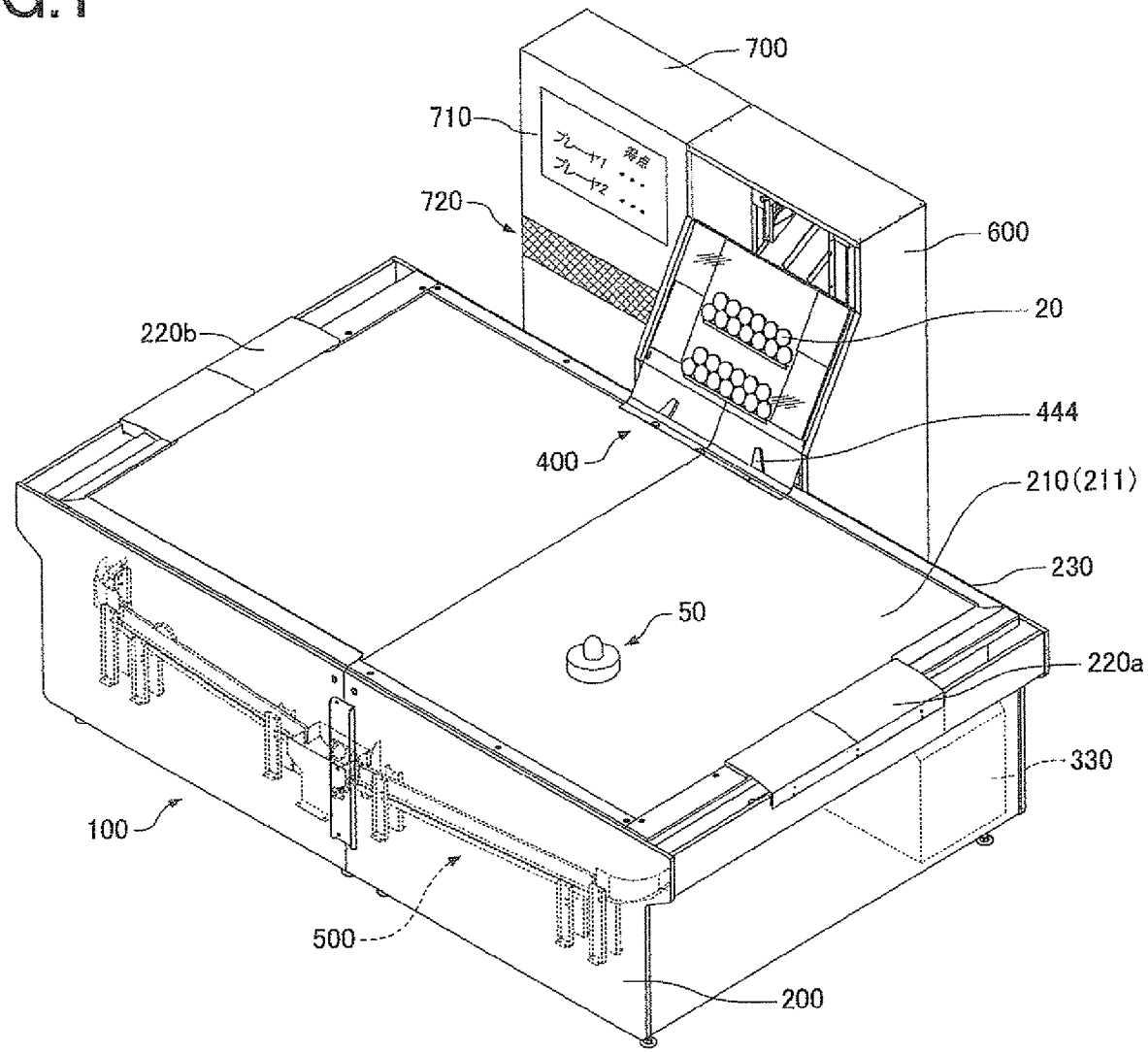
FIG. 1 is an external perspective view illustrating the appearance of an air hockey game device according to one embodiment of the invention.

The configuration of an air hockey game device 100 according to one embodiment of the invention is described below with reference to FIGS. 1, 2A and 2B. FIG. 1 is an external perspective view illustrating the appearance of the air hockey game device 100 according to one embodiment of the invention. FIG. 2A is a top view illustrating a first puck 10 according to one embodiment of the invention, and FIG. 213 is a top view illustrating a second puck 20 according to one embodiment of the invention.

Figure 2B:
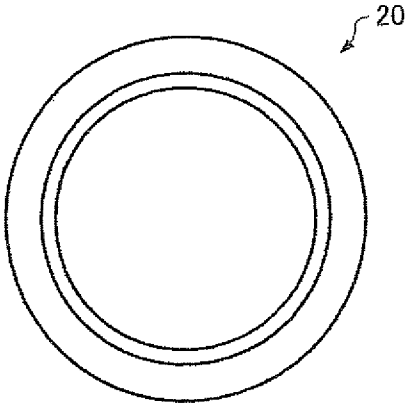
FIG. 2B is a top view illustrating a second puck according to one embodiment of the invention.
Figure 2A:
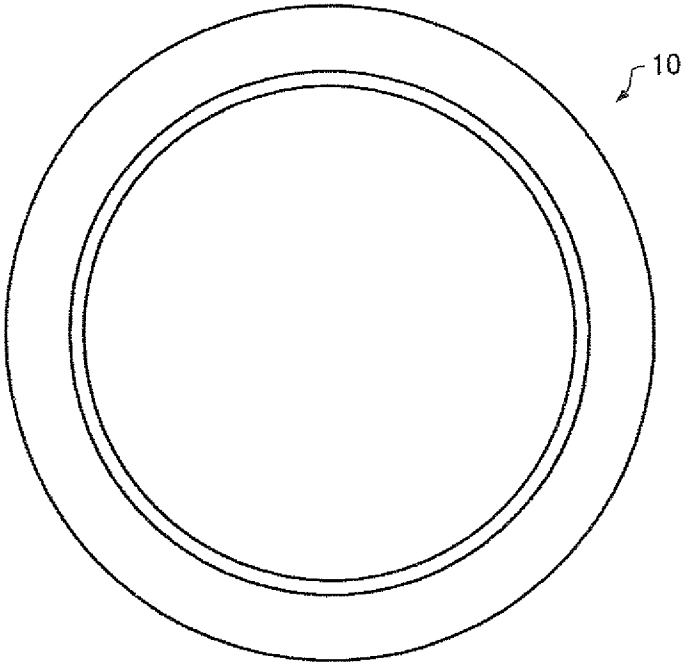
FIG. 2A is a top view illustrating a first puck according to one embodiment of the invention.

The air hockey game device 100 allows a plurality of players to play a match game using the disc-like first puck 10 and the disc-like second puck 20 having a size (disc size) smaller than that of the first puck 10 (see FIGS. 1, 2A and 2B).

The air hockey game device 100 is configured so that each player can score points by shooting the first puck 10 and the second puck 20 into the opponent's goal (i.e., goal pocket 220 described later).

The air hockey game device 100 is configured to control the game process (e.g., collection/supply of the first puck 10 and the second puck 20, calculation/display of score, and production effect) based on the type of puck.

As illustrated in FIG. 1, the air hockey game device 100 structurally includes a housing 200, a field board 210, a goal pocket 220, an air supply unit 330, a supply unit 400, a collection/transfer unit 500, a loading unit 600, and a notification unit 700. The air hockey game device 100 also includes a drive control unit 800 (see FIG. 8) that is provided inside the housing 200.

Note that the collection/transfer unit 500 implements a collection/transfer mechanism, and the loading unit 600 implements a loading unit, for example. The drive control unit 800 implements a game control unit, for example.

The housing 200 has a given height, and is formed to have an approximately rectangular shape in a plan view. The housing 200 supports the field board 210 that is formed on the upper side. The housing 200 provides a stable base so that each player can play the air hockey game on the field board 210.

Specifically, the housing 200 is formed so that each player can hit the first puck 10 and the second puck 20 that slide on the field board 210 using a mallet 50, and defend his goal pocket 220 (i.e., the goal pocket 220 along the short side where the player stands) from the first puck 10 and the second puck 20.

The air supply unit 330, the collection/transfer unit 500, and the drive control unit 800 are provided inside the housing 200. The loading unit 600 and the supply unit 400 that is connected to the loading unit 600 are provided at the center on one side of the housing 200.

The field board 210 functions as a field on which the first puck 10 and the second puck 20 slide while being floated due to air, and serves as a game area of the air hockey game.

The field board 210 is formed to have an approximately rectangular shape in the same manner as the housing 200, and has a plurality of air holes 211 that are formed in the surface of the board (hereinafter may be referred to as "field board surface" or "sliding surface"), and discharge air in order to float the first puck 10 and the second puck 20.

Each air hole 211 is formed by a small through-hole. The air holes 211 are almost evenly formed over the entire surface of the field board 210 at given intervals. Each air hole 211 discharges air supplied from the air supply unit 330 provided inside the housing 200 in the upward direction that is perpendicular to the field board 210 in order to float the first puck 10 and the second puck 20. Each air hole 211 is formed by a small through-hole. The air holes 211 are almost evenly formed over the entire surface of the field board 210 at given intervals.

The field board 210 includes a wall (hereinafter may be referred to as "wall member") 230 that is provided in the periphery of the rectangular game area, and has a given height from the field board surface, the wall 230 being formed upright to prevent the first puck 10 and the second puck 20 from leaving the field.

Each goal pocket 220 is used as a goal area (i.e., an area targeted by the player). Each goal pocket 220 is formed at the center of each short side of the field board 210, and is provided corresponding to each player (corresponding to each team when a plurality of players forms a team).

Each goal pocket 220 receives the first puck 10 and the second puck 20, and sequentially discharges the first puck 10 and the second puck 20 received therein to the collection/transfer unit 500.

When the first puck 10 and the second puck 20 have been supplied to the field board 210 at an identical tuning, each goal pocket 220 receives different pucks such as the first puck 10 and the second puck 20 in a mixed state.

Each goal pocket 220 is configured to sequentially discharge the first puck 10 and the second puck 20 received therein to the collection/transfer unit 500 even when each goal pocket 220 has received the first puck 10 and the second puck 20 in a mixed state.

The details of the configuration of the goal pocket 220 according to one embodiment of the invention are described later.

The air supply unit 330 is used to supply air to the field board 210 in order to float the first puck 10 and the second puck 20. For example, the air supply unit 330 includes a compressor that compresses air, and supplies air compressed by the compressor to the air holes 211 formed in the field board surface during the game under control of the drive control unit 800.

The supply unit 400 is used to supply different types of pucks (i.e., first puck 10 and second puck 20) to the field board 210. The supply unit 400 is provided upright at the center on one side of the housing 200, the upper end of the supply unit 400 being connected to the upper end of the loading unit 600 so that the first puck 10 and the second puck 20 are loaded into the supply unit 400 from the loading unit 600.

The first puck 10 is loaded into the supply unit 400 from the loading unit 600 at a given timing under control of the drive control unit 800. The supply unit 400 selectively supplies the loaded first puck 10 to the field board 210 along a path 441*a* or 441*b* (see FIG. 4) that is provided corresponding to each goal pocket 220 (i.e., provided corresponding to each player or team) while switching the sliding path of the first puck 10 between the paths 441*a* and 441*b* (see FIG. 4).

The supply unit 400 retains a plurality of second pucks 20, and simultaneously supplies the plurality of second pucks 20 retained therein to the field board 210 when a given condition has been satisfied.

The details of the configuration of the supply unit 400 according to one embodiment of the invention are described later.

Figure 5A:
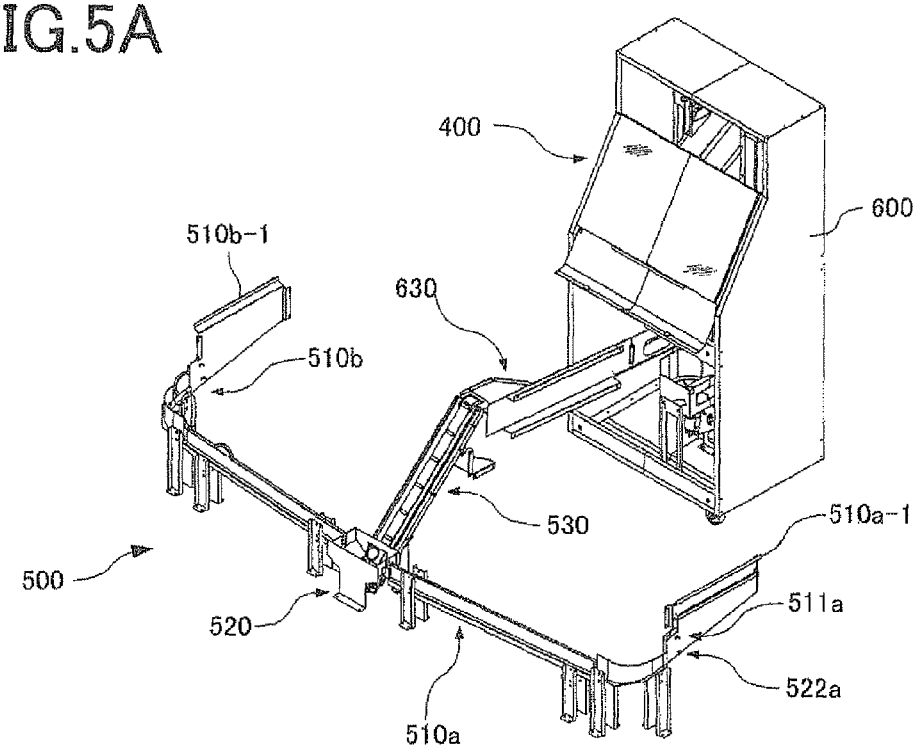
FIG. 5A is an external perspective view and a top view illustrating the appearance of a collection/transfer unit, a supply unit, and a loading unit according to one embodiment of the invention.
Figure 5B:
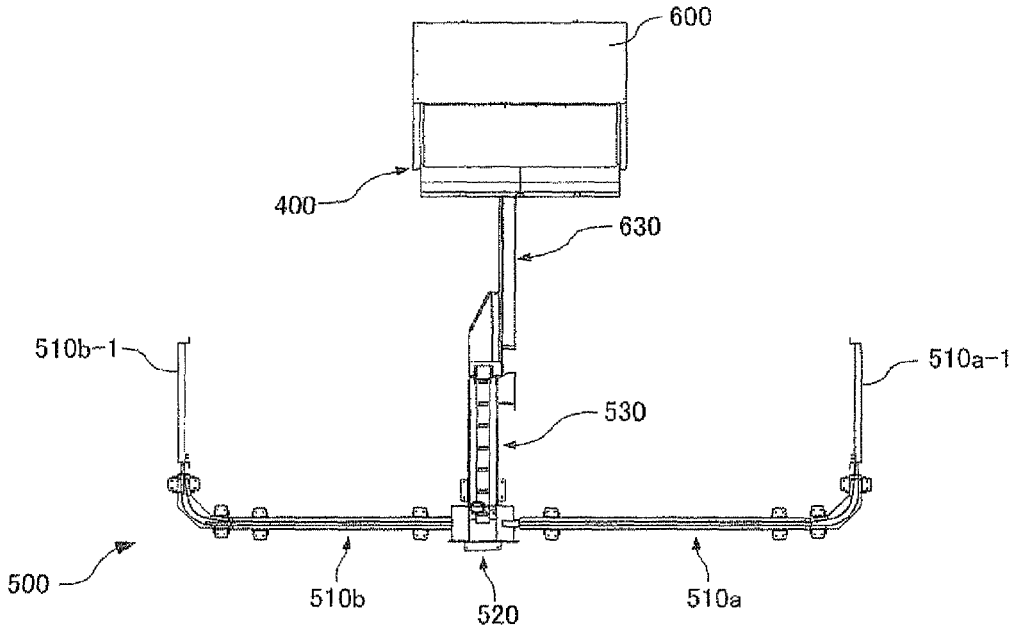
FIG. 5B is a top view illustrating the appearance of a collection/transfer unit, a supply unit, and a loading unit according to one embodiment of the invention.

The collection/transfer unit 500 is used to collect and transfer the first puck 10 and the second puck 20 received by the goal pocket 220. The configuration of the collection/transfer unit 500 is illustrated in FIGS. 5A and 5B.

The collection/transfer unit detects the types and the numbers of the first pucks 10 and the second pucks 20 that are received by each goal pocket 220 in a mixed state under of the control of the drive control unit 800.

The collection/transfer unit 500 transfers the first pucks 10 and the second pucks 20 received by each goal pocket 220 along an identical transfer path to collect the first pucks 10 and the second pucks 20.

The collection/transfer unit 500 transfers the first pucks 10 and the second pucks 20 thus collected to the loading unit 600. The details of the configuration of the collection/transfer unit 500 according to one embodiment of the invention are described later.

The loading unit 600 loads the first pucks 10 and the second pucks 20 that have been transferred and collected by the collection/transfer unit 500 into the supply unit 400.

Figure 6B:
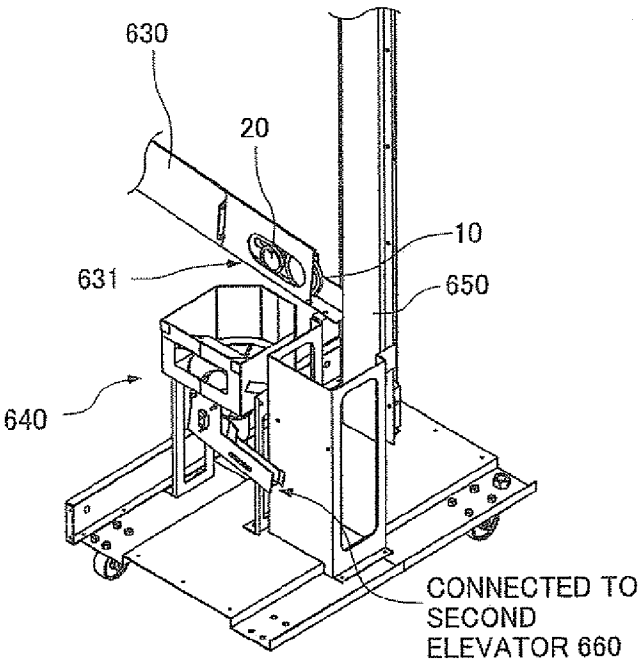
FIG. 6B is a rear perspective view illustrating the rear side of a loading unit according to one embodiment of the invention.
Figure 6A:
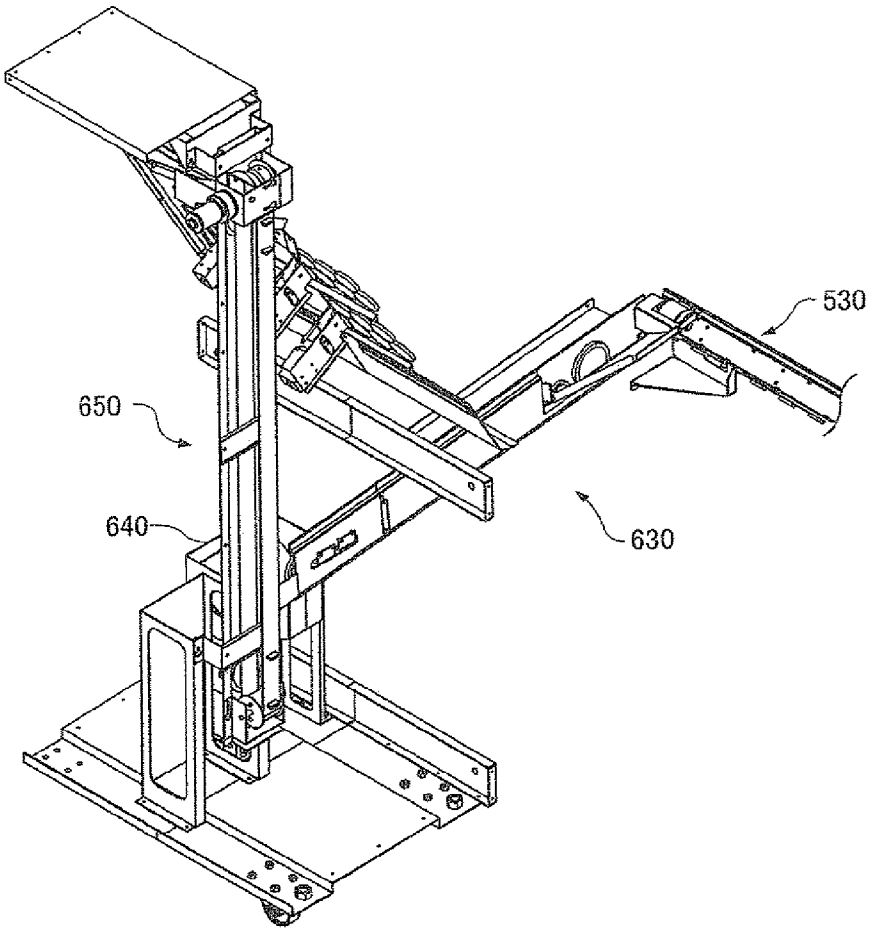
FIG. 6A is a rear perspective view illustrating the rear side of a loading unit according to one embodiment of the invention.
Figure 7:
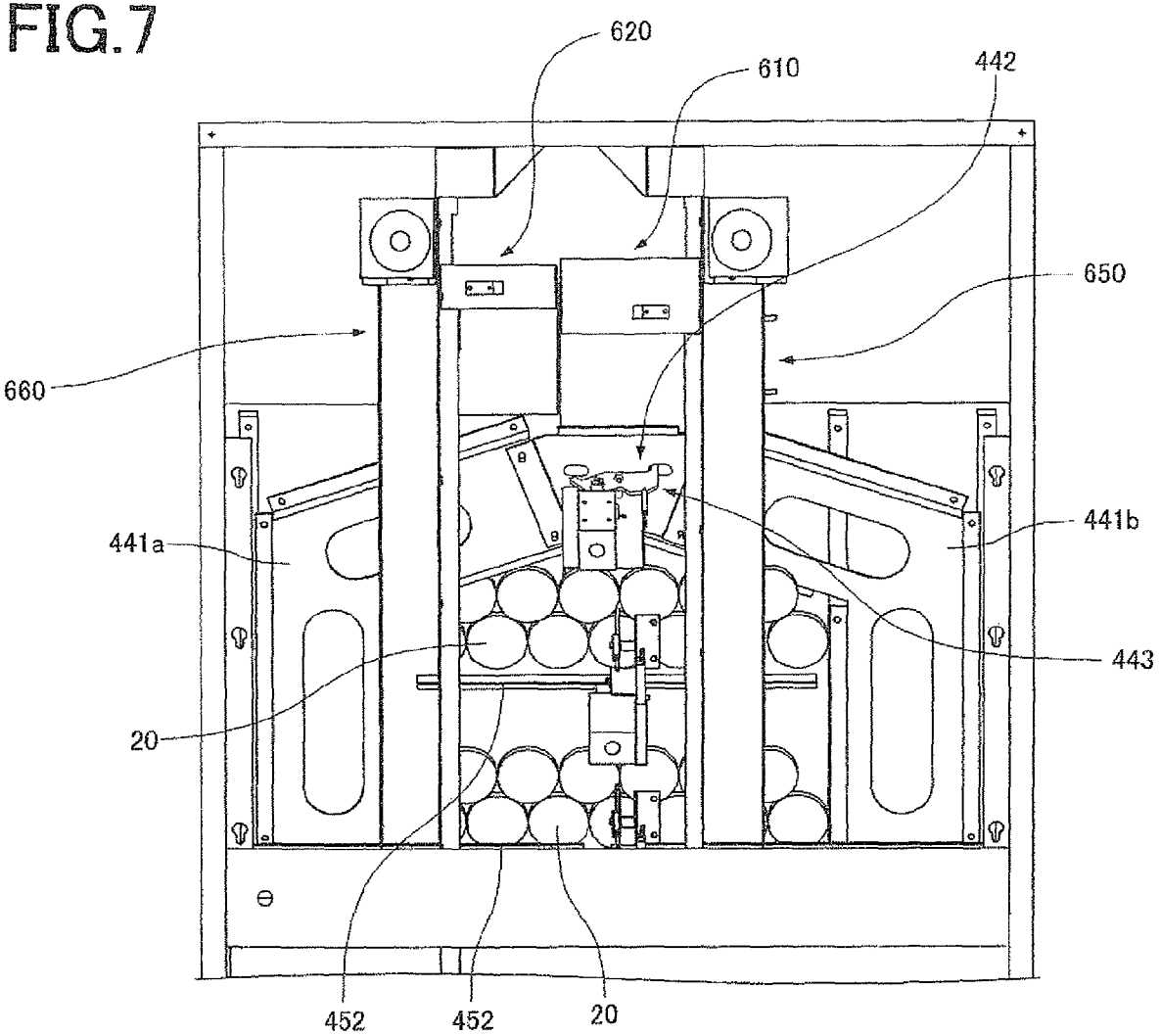
FIG. 7 is a rear view illustrating part of the rear side of a loading unit according to one embodiment of the invention.

The loading unit 600 is provided upright at the center on one side of the housing 200 from the lower side of the housing 200 to the upper side of the housing 200 through the field board surface. The loading unit 600 is connected to the upper end of the supply unit 400 on the upper side of the housing 200, and loads the first pucks 10 and the second pucks 20 into the supply unit 400. The configuration of the loading unit 600 is illustrated in FIGS. 6A, 6B, and 7.

The loading unit 600 sorts out the first pucks 10 and the second pucks 20 transferred by the collection/transfer unit 500 under control of the drive control unit 800. The loading unit 600 retains the first pucks 10, and loads the first pucks 10 directly into the supply unit 400.

The loading unit 600 temporarily retains a plurality of second pucks 20. The loading unit 600 loads a plurality of second pucks 20 into the supply unit 400 along a path that differs from that of the first pucks 10. The details of the configuration of the loading unit 600 according to one embodiment of the invention are described later.

The notification unit 700 notifies necessary information during the game. The notification unit 700 is provided at the center on one side of the housing 200 on which the loading unit 600 and the supply unit 400 are provided.

The notification unit 700 provides a given notification and a given effect at a predetermined timing (e.g., at a timing at which the first puck 10 or the second puck 20 has entered the goal pocket 220) under control of the drive control unit 800.

The notification unit 700 includes a liquid crystal display 710 that displays the score, the game time, or a game effect under control of the drive control unit 800, and a plurality of speakers 720 that outputs a given effect sound and music under control of the drive control unit 800 when the score, the game time, or a game effect is displayed.

Note that the notification unit 700 may be provided at the center on the side of the housing 200 opposite to the side on which the loading unit 600 and the supply unit 400 are provided, or may be may be provided on the upper side of the housing 200. The notification unit 700 includes a lighting unit (not illustrated in the drawings) that provides a lighting effect (e.g., blinking, light-on, and light-off) when the game effect is displayed.

Each speaker 720 is independently provided to face each player, and is formed to have directivity that allows each player to listen to the effect sound. Each speaker 720 outputs a given effect sound under a given situation.

For example, when the first puck 10 or the second puck 20 has entered the goal pocket 220, each speaker 720 outputs the effect sound having a different tone to the player who has shot the puck into the opponent's goal and the player who has conceded a goal.

When the second puck 20 has entered the goal pocket 220, each speaker 720 outputs the effect sound so that the pitch gradually increases each time the second puck 20 has entered the same goal pocket 220. In this case, each speaker 720 outputs the effect sound at the initial pitch when the pitch of the effect sound has reached a given pitch. Therefore, even when the players cannot determine the number of second pucks 20 that have been shot into a goal when a large number of second pucks 20 have been supplied to the field board 210, the players can determine the number of second pucks 20 due to the effect sound.

The drive control unit 800 is a control unit for controlling (driving) each unit. The drive control unit 800 starts to control each unit when a coin (e.g., token) has been inserted, and controls the process of the air hockey game based on the role of each puck (first puck 10 and second puck 20) in the game (hereinafter may be expressed as "based on the type of puck (or game medium)").

The drive control unit 800 controls the air supply unit 330 when the air supply unit 330 supplies air, controls the supply unit 400 when the supply unit 400 supplies the first puck 10 and the second puck 20, controls the notification unit 700 when the notification unit 700 display an image and output sound, and controls the collection/transfer unit 500 and the loading unit 600. Note that the details of the configuration of the drive control unit 800 according to one embodiment of the invention are described later.

Puck

The first puck 10 and the second puck 20 according to one embodiment of the invention are described below with reference to FIGS. 2A and 2B.

As illustrated in FIG. 2A, the first puck 10 is a disc-like game medium that floats and slides on the field board 210. The first puck 10 is formed so that the center area of the disc surface has a thickness smaller than that of the periphery of the disc surface. This prevents a situation in which the first puck 10 adheres to the field board surface when the first puck 10 slides or stops on the field board 210. Specifically, when the disc surface of the first puck 10 has an even thickness, the space between the first puck 10 and the field board 210 may be lost when the first puck 10 slides or stops on the field board, and the first puck 10 may adhere to the field board 210 since the first puck 10 cannot receive air supplied through the air hole 211. Therefore, the first puck 10 is configured so that a recess is formed in the center area of the disc surface such that the first puck 10 can receive air supplied through the air hole 211. This prevents a situation in which the first puck 10 adheres to the field board surface.

As illustrated in FIG. 28, the second puck 20 is a disc-like game medium that floats and slides on the field board 210. The second puck 20 is formed so that the center area of the disc surface has a thickness smaller than that of the periphery of the disc surface. This prevents a situation in which the second puck 20 adheres to the field board surface when the second puck 20 slides on the field board 210.

The second puck 20 is formed so that the disc size is smaller than that of the first puck 10 (e.g., the disc diameter is half of that of the first puck 10), and the thickness of the disc surface is smaller than that of the first puck 10, in order to allow the second puck 20 to slide at a speed differing from that of the first puck 10, and produces a hitting feel differing from that of the first puck 10. When the second puck 20 is formed to have a disc size smaller than that of the first puck 10, the first puck 10 and the second puck 20 slide at a different speed even when the first puck 10 and the second puck 20 have been hit at an identical force using an identical mallet 50. More specifically, even when the first puck 10 and the second puck 20 have been hit at an identical force using an identical mallet 50, the second puck 20 slides on the field board surface at a speed higher than that of the first puck 10 (i.e., the first puck 10 slides on the field board surface at a speed lower than that of the second puck 20).

In one embodiment of the invention, the game playability is changed by simultaneously supplying different pucks to the field board 210 (game area) to implement an exciting game.

Note that the first puck 10 and the second puck 20 may differ in thickness, or may have an identical thickness.

In one embodiment of the invention, the second puck 20 is formed to have a disc size and a thickness smaller than those of the first puck 10. Note that the second puck 20 may be formed to have a weight larger than that of the first puck 10, or may be formed using a material that allows the second puck 20 to slide at a speed higher than that of the first puck 10.

The disc surface of the second puck may be coated with a coating material that allows the second puck 20 to slide at a speed higher than that of the first puck 10.

Goal Pocket

Figure 3A:
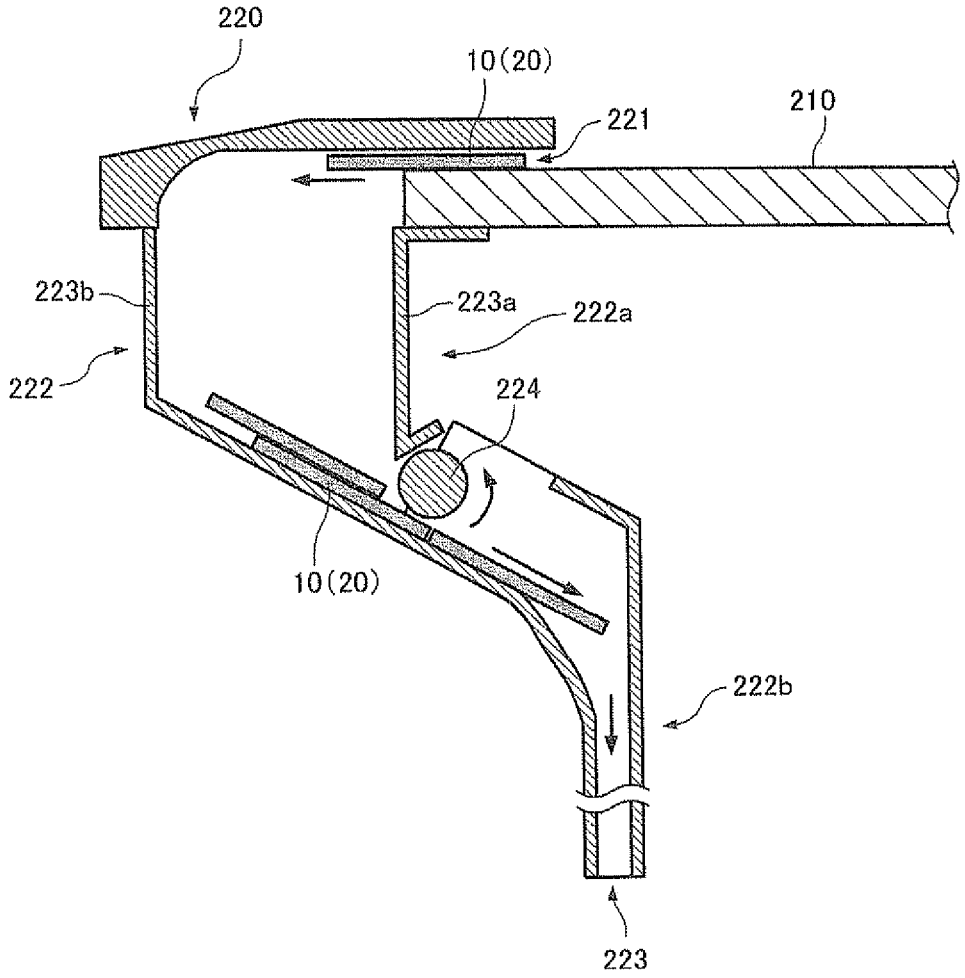
FIG. 3A is a schematic view illustrating a cross section around a goal pocket according to one embodiment of the invention.

The structure of the goal pocket 220 according to one embodiment of the invention is described below with reference to FIGS. 3A and 3B. FIG. 3A is a schematic view illustrating a cross section around the goal pocket 220 according to one embodiment of the invention, and FIG. 38 is an external perspective view illustrating part of the goal pocket 220 according to one embodiment of the invention.

The left goal pocket 220 illustrated in FIG. 1 is a first goal pocket 220*a* that is defended by a first player, and the right goal pocket 220 illustrated in FIG. 1 is a second goal pocket 220*b* that is defended by a second player who plays against the first player.

Figure 3B:
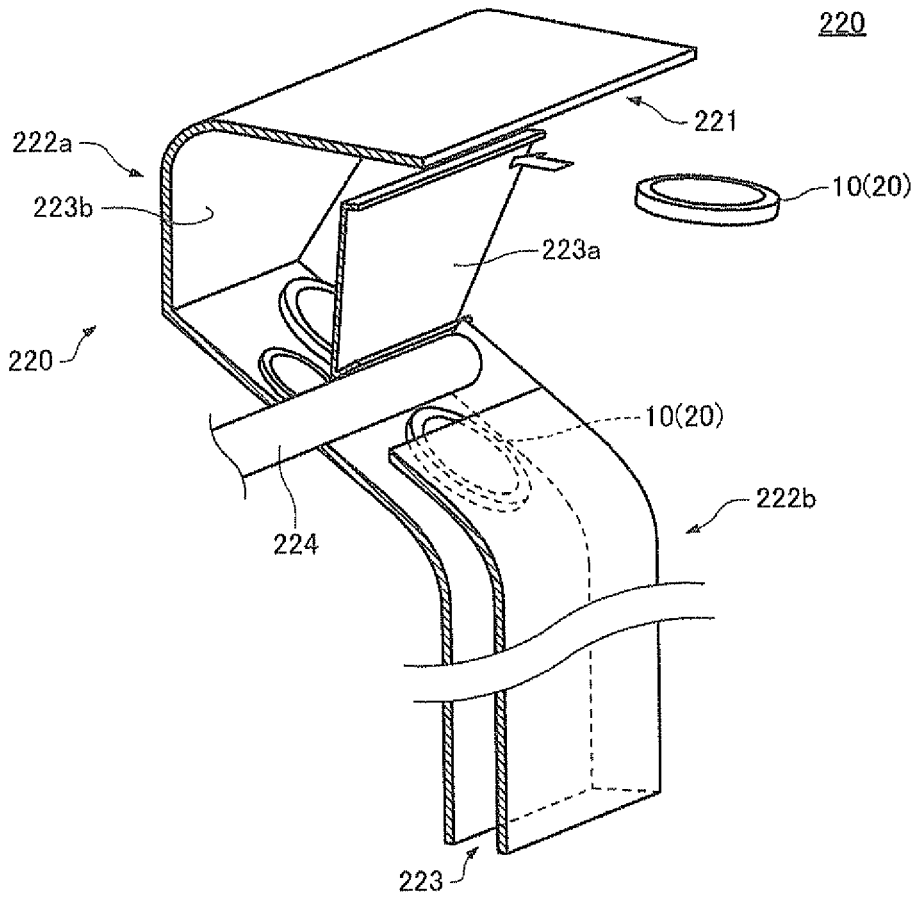
FIG. 3B is an external perspective view illustrating part of a goal pocket according to one embodiment of the invention.

As illustrated in FIGS. 3A and 3B, each goal pocket 220 includes an opening 221, a receiving section 222, an outlet 223, and a discharge roller 224. The discharge roller 224 functions as a discharge unit.

The opening 221 is formed at the center on the short side of the field board 210, and is formed at the same level as the field board surface. The opening 221 functions as a goal that receives the first puck 10 and the second puck 20. Specifically, the opening 221 has a given width and a given height from the field board surface, and is formed to receive the first puck 10 and the second puck 20 that slide on the field board 210.

The receiving section 222 is formed integrally with the opening 221, and receives the first puck 10 and the second puck 20 that have entered through the opening 221 (i.e., have been shot into the goal). The receiving section 222 has a structure that guides the first puck 10 and the second puck 20 received therein to the outlet 223 that is provided on the lower side.

More specifically, the receiving section 222 includes a receiving box 222*a* in which the opening 221 is formed on the upper front side, and a narrow guide box 222*b* in which the outlet 223 is formed at the bottom, and guides the first puck 10 and the second puck 20 that have entered through the opening 221 from the receiving box 222*a* to the outlet 223 that has a narrow rectangular shape and is positioned under the guide box 222*b*.

The receiving box 222*a* has a first side surface 223*a* that is formed to extend downward along the edge of the short side of the field board 210, and a second side surface 223*b* that is opposite to the first side surface 223*a*, and guides the first puck 10 and the second puck 20 that have entered through the opening 221.

The second side surface 223*b* slopes downward toward the first side surface 223*a*, and is formed to guide the first puck 10 and the second puck 20 to the narrow guide box 222*b* that is positioned under the receiving box 222*a*.

The outlet 223 that is formed in a bottom 223*e* of the guide box 222*b* is a rectangular opening that is longer in the short side direction of the field board 210. The outlet 223 is formed to sequentially discharge the first puck 10 or the second puck 20 under control of the discharge roller 224.

The thickness (i.e., the width in the transverse direction) of the outlet 223 is set to be equal to or larger than the thickness of the first puck 10 and less than the total thickness of two second pucks 20 that are stacked on the disc surface so that a plurality of first pucks 10, a plurality of second pucks 20, or the first puck 10 and the second pucks 20 are not discharged at one time.

Specifically, the outlet 223 is formed to have a thickness (i.e., the width in the transverse direction) equal to or larger than the thickness of the first puck 10 having the maximum thickness (Tmax) among the plurality of pucks and less than the total thickness (2Tmin) of two second pucks 20 having the minimum thickness (Tmin) among the plurality of pucks that are stacked on the disc surface. The outlet 223 has a width (width in the longitudinal direction) that allows a plurality of pucks to be discharged at the same time.

Note that a first transfer rail 510*a* or a second transfer rail 520*b* (described later) are disposed along and underneath the outlet 223 that is a rectangular opening that is longer in the short side direction of the field board 210.

Specifically, a transfer receiving rail section 510*a*-1 and a transfer receiving rail section 510*b*-1 as the starting point of the first transfer rail 510*a* and the second transfer rail 510*b* are disposed along the outlet 223 of the goal pocket 220*a* and the outlet 223 of the goal pocket 220*b* (see FIGS. 5A and 5B) in order to receive the first puck 10 or the second puck 20 that is discharged downward from the outlet 223 (i.e., a rectangular opening that is longer in the short side direction of the field board 210), and transfer the first puck 10 or the second puck 20 along a given transfer path.

The discharge roller 224 is provided on the lower side of the receiving box 222*a* to be positioned to face the entrance of the guide box 222*b*. Note that only a small space that does not allow the puck to pass through is formed between the discharge roller 224 and the first side surface 223*a*.

The discharge roller 224 is disposed so that a space through which the first puck 10 and the second puck 20 can be guided downward is formed between the discharge roller 224 and the second side surface 223*b*. Specifically, the discharge roller 224 and the second side surface 223*b* of the receiving box 222*a* of the receiving section 222 form a puck discharge space that is thicker to some extent than the thickness of the first puck 10 on the upstream side of the guide box 222*b*.

The discharge roller 224 rotates in the direction indicated by the arrow in no. 3A during the game under control of the drive control unit 800. Therefore, the discharge roller 224 can sequentially and smoothly guide the first puck 10 and the second puck 20 to the outlet 223 through the puck discharge space.

More specifically, elevations and depressions are formed on the surface of the discharge roller 224. Therefore, even when a plurality of first pucks 10, a plurality of second pucks 20, or the first puck 10 and the second puck 20 have move to the puck discharge space in a stacked state, the discharge roller 224 that rotates can push the upper puck (puck positioned close to the discharge roller 224) backward due to the elevations and depressions formed on the surface, and guide only the other puck (puck that does not come in contact with the discharge roller 224) to the outlet 223 (guide box 222*b*).

Specifically, the discharge roller 224 is provided to cancel a state in which the pucks are stacked in order to independently transfer first puck 10 and the second puck 20 using the collection/transfer unit 500.

According to the above configuration, the first puck 10 and the second puck 20 that have entered through the opening 221 (i.e., have been shot into the goal) (see the arrow in FIGS. 3A and 3B) slide and align inside the receiving box 222*a* along the slope of the second side surface 223*b*.

When two first pucks 10 or two second pucks 20 are stacked, the upper puck is moved backward by the discharge roller 224 toward the second side surface 223*b*, and only the lower puck passes through the space between the discharge roller 224 and the second side surface 223*b*, and is guided to the guide box 222*b*.

Note that only one first puck 10 or only one second puck 20 can pass through the space between the discharge roller 224 and the second side surface 223*b*.

The first puck 10 or the second puck 20 that has passed through the space between the discharge roller 224 and the second side surface 223*b* is sequentially supplied to the guide box 222*b*, and discharged to the first transfer rail 510*a* or the second transfer rail 520*b* disposed under the outlet 223.

Therefore, the first puck 10 or the second puck 20 that has been discharged sequentially rolls along the first transfer rail 510*a* or the second transfer rail 520*b* in an aligned state.

Supply Unit

Figure 4:
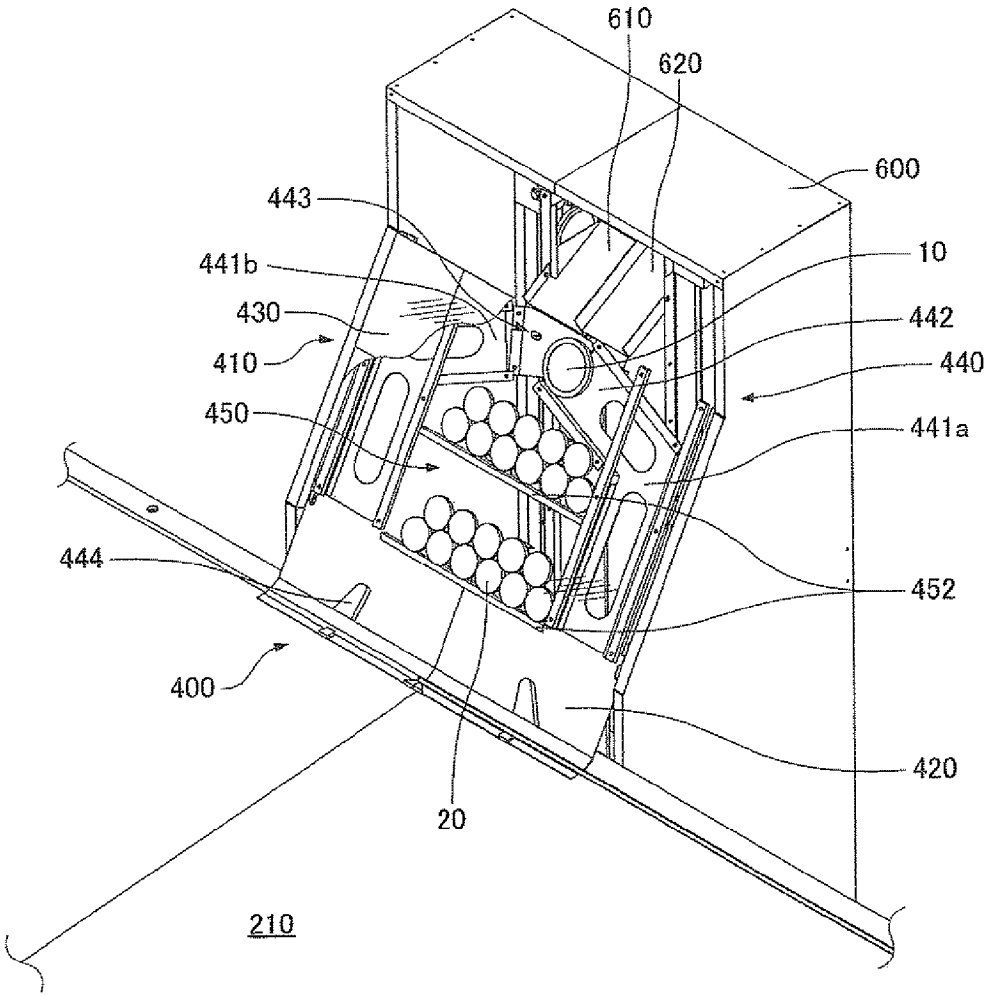
FIG. 4 is an external perspective view illustrating the appearance of a supply unit according to one embodiment of the invention.

The structure of the supply unit 400 according to one embodiment of the invention is described below with reference to FIGS. 4 and 7. FIG. 4 is an external perspective view illustrating the appearance of the supply unit 400 according to one embodiment of the invention, and FIG. 7 is a rear view illustrating part of the supply unit 400 and the loading unit 600 according to one embodiment of the invention.

As illustrated in FIG. 5, the supply unit 400 includes a slope member 410, a supply guide member 420, and a transparent cover 430.

The slope member 410 has a slope that is formed at a given slope angle with respect to the surface of the field board 210.

The supply guide member 420 is formed integrally with the slope member 410, and is used to slidably supply the first puck 10 and the second puck 20 that have been loaded into the slope member 410 and slid due to their weight to the field board 210.

The supply guide member 420 has a shape that is curved obliquely upward with respect to the field board 210, and supplies the first puck 10 or the second puck 20 that has slid from the slope member 410 to the field board 210 in an approximately horizontal direction.

The lower end of the supply guide member 420 is formed to come in contact with, or to be adjacent to, the upper end of the wall 230 formed on the periphery of the field board 210. The supply guide member 420 can thus slidably supply the first puck 10 and the second puck 20 to the field board 210.

The transparent cover 430 is provided opposite to the slope member 410. The transparent cover 430 is formed to prevent the first puck 10 and the second puck 20 from leaving the supply unit 400 or the field board 210 when the first puck 10 and the second puck 20 are loaded or supplied, and allow the player to observe the loaded state of the second puck 20.

The supply unit 400 includes a supply section 440 (hereinafter referred to as "first supply section") that slidably supplies the first puck 10 to the field board 210, and a supply section 450 (hereinafter referred to as "second supply section") that slidably supplies the second puck 20 to the field board 210. The first supply section 440 and the second supply section 450 respectively include the slope member 410, the supply guide member 420, and the transparent cover 430.

The first supply section 440 supplies the first puck 10 loaded by the loading unit 600 to the field board 210 slidably along the slope of the slope member 410 while maintaining a state in which the disc surface of the first puck 10 faces obliquely upward.

Specifically, the first supply section 440 supplies the first puck 10 toward the player who has conceded a goal (i.e., the goal pocket 220 into which the puck has been shot) while switching the slide path of the first puck 10.

For example, the first supply section 440 has a pair of (left and right) independent paths 441*a* and 441*b*, and a switch path 442. The independent paths 441*a* and 44113 are formed on either side of the slope member 410 (i.e., on either side of the slope member 410 in the widthwise direction that is perpendicular to (intersects) the slope direction of the slope member 410.

The independent paths 441*a* and 441*b* sandwich the second supply section 450 provided at the center of the slope member 410, and are divided from the second supply section 450.

The independent paths 441*a* and 441*b* have a width slightly larger than the diameter of the first puck 10. The upstream area of the independent path 441*a* and the upstream area of the independent path 441*b* are adjacent to each other so that the second supply section 450 is placed between the transparent cover 430 and the surface of the slope member 410, and the downstream area of the independent path 441*a* and the downstream area of the independent path 441*b* are formed by the supply guide member 420.

A restriction member 444 is provided to the downstream area of the independent path 441*a* and the downstream area of the independent path 441*b* that are formed by the supply guide member 420 so that the first puck 10 is supplied to the field board 210 at a given angle in the widthwise direction. Specifically, the restriction member 444 is provided to the downstream area of the independent path 441*a* and the downstream area of the independent path 441*b* so that the first puck 10 is supplied to the field board 210 toward the goal pocket 220 that is positioned closer.

The switch path 442 has a width slightly larger than the diameter of the first puck 10 in the same manner as the independent paths 441*a* and 441*b*, and is in the shape of an inverted letter "Y" along the slope of the slope member 410.

The switch path 442 is formed to overlap the upper part of the rear side of the second supply section 450, and has a structure that guides the first puck 10 to the independent path 441*a* or 441*b* while allowing the first puck 10 loaded by the loading unit 600 to slide due to its weight.

Specifically, the upper end of the switch path 442 is bonded to a first slider 610 of the loading unit 600 that outputs the first puck 10 approximately at the center of the slope member 410 in the widthwise direction. The lower ends of the switch path 442 are respectively connected to the independent paths 441*a* and 441*b*.

A path switch movable member 443 that moves under control of the drive control unit 800 is provided to the branch point of the switch path 442. The path switch movable member 443 is controlled so that the first puck 10 is slidably supplied to the independent path 441*a* or 441*b* that is positioned on the side of the player who has conceded a goal.

For example, the path switch movable member 443 has a protrusion that protrudes from two holes formed in the surface of the path toward the front surface (transparent cover 430). The drive control unit 800 selectively causes the protrusion to protrude from one of the holes formed in the surface of the path.

According to the above configuration, when one of the independent paths 441*a* and 441*b* has been selected by the path switch movable member 443, the first supply section 440 can prevent entrance into the other of the independent paths 441*a* and 441*b*, and can slide the first puck 10 loaded into the designated independent path 441.

Therefore, the first supply section 440 can supply the first puck 10 toward the player who has conceded a goal by supplying the first puck 10 from the independent path 441*a* or 441*b* that is positioned closer to the goal pocket 220 into which the puck has been shot.

The second supply section 450 is shaped so that a plurality of second pucks 20 loaded by the loading unit 600 are arranged in the widthwise direction (that is the direction that is perpendicular to (intersects) the slope direction of the slope member 410) and the slope direction in a state in which the disc surface faces upward.

The upper end of the second supply section 450 is bonded to a second slider 620 of the loading unit 600 that loads the second puck 20 in an area in which the upper end of the second supply section 450 does not overlap the first slider 610 of the loading unit 600.

The end of the second supply section 450 opposite to the end bonded to the loading unit 600 (i.e., the end of the second supply section 450 under the slope member 410) is formed by the supply guide member 420.

The second supply section 450 retains a plurality of second pucks 20 while maintaining the current arrangement state. The second supply section 450 slidably supplies a plurality of second pucks 20 that is retained and arranged in a plurality of rows simultaneously to the field board 210 when a given condition has been satisfied.

Specifically, the second supply section 450 is formed so that the second supply section 450 is divided from and positioned between the independent paths 441 of the first supply section 440 (i.e., formed at the center in the widthwise direction), and has a width that allows a plurality of second pucks 20 to be arranged in the widthwise direction (e.g., a width that allows six second pucks 20 to be arranged in the widthwise direction).

A sensor 451 that detects passage of the second puck 20 (hereinafter referred to as "second puck loading sensor") (see FIG. 8) is provided at the joint. The second puck loading sensor 451 is used when counting the number of loaded second pucks 20 together with a counter circuit 830 described later.

The second supply section 450 includes a plurality of stoppers 452 that is formed by a protrusion member that extends in the widthwise direction and has a height equal to or larger than the thickness of the second puck 20, and prevent the slide motion of the second pucks 20 (i.e., hold the second pucks 20).

Specifically, the second supply section 450 is formed so that a given number of second pucks 20 (hereinafter may be referred to as "a set of second pucks") can be retained corresponding to each stopper 452.

The lowermost stopper 452 is set to an open state when a given condition has been satisfied, and slidably supplies the second pucks 20 that are retained by the stopper 452 to the field board 210 under control of the drive control unit 800.

Specifically, the lowermost stopper 452 tilts downward, or the height of the protrusion decreases toward the slope member 410 to eliminate the step with the slope member 410 so that the second pucks 20 can slide when a given condition has been satisfied. Note that the lowermost stopper 452 is formed on the slope member 410, and is not formed on the supply guide member 420.

The stoppers 452 other than the lowermost stopper 452 sequentially change from the closed state to the open state when the lowermost stopper 452 has changed from the closed state to the open state, and a set of second pucks 20 can be retained using the lower stopper 452.

The stoppers 452 other than the lowermost stopper 452 change from the closed state to the open state at the same timing as the lowermost stopper 452 under given conditions. Specifically, the stoppers 452 other than the lowermost stopper 452 are controlled to slidably supply the second pucks held by each stopper 452 to the field board 210 together with the second pucks held by the lowermost stopper 452.

According to the above configuration, the second supply section 450 can simultaneously supply a plurality of second pucks 20 to the field board 210 under control of the drive control unit 800.

Collection/transfer Unit

The structure of the collection/transfer unit 500 according to one embodiment of the invention is described below with reference to FIGS. 5A and 5B. FIG. 5A is an external perspective view illustrating the appearance of the collection/transfer unit 500, the supply unit 400, and the loading unit 600 according to one embodiment of the invention, and FIG. 5B is a top view illustrating the appearance of the collection/transfer unit 500, the supply unit 400, and the loading unit 600 according to one embodiment of the invention.

As illustrated in FIGS. 5A and 5B, the collection/transfer unit 500 includes a transfer rail 510, a collection box 520, and a belt conveyer 530.

The transfer rail 510 is provided corresponding to each goal pocket 220. A first transfer rail 510*a* is provided corresponding to the first goal pocket 220*a*, and a second transfer rail 510*b* is provided corresponding to the second goal pocket 220*b*. Note that the transfer rail 510 implements a transfer path, and the belt conveyer 530 implements a transfer unit, for example.

Each transfer rail 510 is formed along the inner side surface of the housing 200, and is used as a guide rail for transferring the first puck 10 and the second puck 20 while allowing the first puck 10 and the second puck 20 to rotate.

Each transfer rail 510 includes a rail that is formed to be slightly wider than the disc thickness of the first puck 10 and the second puck 20, and a guide that is provided on each side of the rail, and has a height equal to or larger than the diameter of the first puck 10.

Each transfer rail 510 includes the transfer receiving rail section 510*a*-1 or 510*b*-1 that serves as the starting point of the first transfer rail 510*a* or the second transfer rail 510*b*.

The transfer receiving rail sections 510*a*-1 and 510*b*-1 are formed along and underneath the outlet 223 of each goal pocket 220, and formed so that the first puck 10 and the second puck 20 discharged from the outlet 223 are rotatably loaded.

Specifically, each transfer rail 510 is formed at a position at which the side surface (hereinafter referred to as "circumferential surface") formed along the periphery of the disc of the first puck 10 and the second puck 20 discharged from each goal pocket 220 comes in contact with the rail surface, and is fitted between the guides formed on the rail side.

Each transfer rail 510 has a given difference in height in an area from the vicinity of the outlet 223 to the collection box 520. Specifically, each transfer rail 510 is formed so that the first puck 10 and the second puck 20 can be transferred from the vicinity of the outlet 223 to the collection box 520 that is formed at a position lower than the vicinity of the outlet 223 while the first puck 10 and the second puck 20 rotate due to the weight thereof.

Each transfer rail 510 includes a first type detection sensor 511 and a second type detection sensor 522 that are provided at a position between the goal pocket 220 and the collection box 520 (hereinafter referred to as "rail position") in order to detect whether the puck is the first puck 10 or the second puck 20. The first type detection sensor 511 and the second type detection sensor 522 are disposed at a different height from the rail surface.

The first type detection sensor 511 is disposed at a given rail position along the transfer rail 510 through which the first puck 10 and the second puck 20 discharged from each goal pocket 220 necessarily pass so that the first type detection sensor 511 is positioned higher than the rail surface by a value that is larger than the diameter of the disc surface of the second puck 20 and is equal to or less than the diameter of the disc surface of the first puck 10. The second type detection sensor 522 is positioned higher than the rail surface by a value equal to or less than the diameter of the disc surface of the second puck 20.

Note that the first type detection sensor 511 implements a goal detection unit, and implements a first sensor, and the second type detection sensor 522 implements the goal detection unit, and implements a second sensor, for example.

According to the above configuration, when the first puck 10 has passed the rail position at which the first type detection sensor 511 and the second type detection sensor 522 are provided, the first type detection sensor 511 and the second type detection sensor 522 detects the first puck 10. When the second puck 20 has passed the rail position at which the first type detection sensor 511 and the second type detection sensor 522 are provided, only the second type detection sensor 522 detects the second puck 20. Therefore, the type of puck can be determined based on the output from the first type detection sensor 511 and the output from the second type detection sensor 522.

Note that the first type detection sensor 511 and the second type detection sensor 522 may be provided at a different rail position. In this case, it is preferable that the second type detection sensor 522 that can detect the first puck 10 and the second puck 20 be provided closer to the goal pocket 220 as compared with the first type detection sensor 511.

The transfer rails 510 respectively correspond to the goal pockets 220*a* and 220*b*, and include the first transfer rail 510*a* and the second transfer rail 510*b*.

Figure 8:
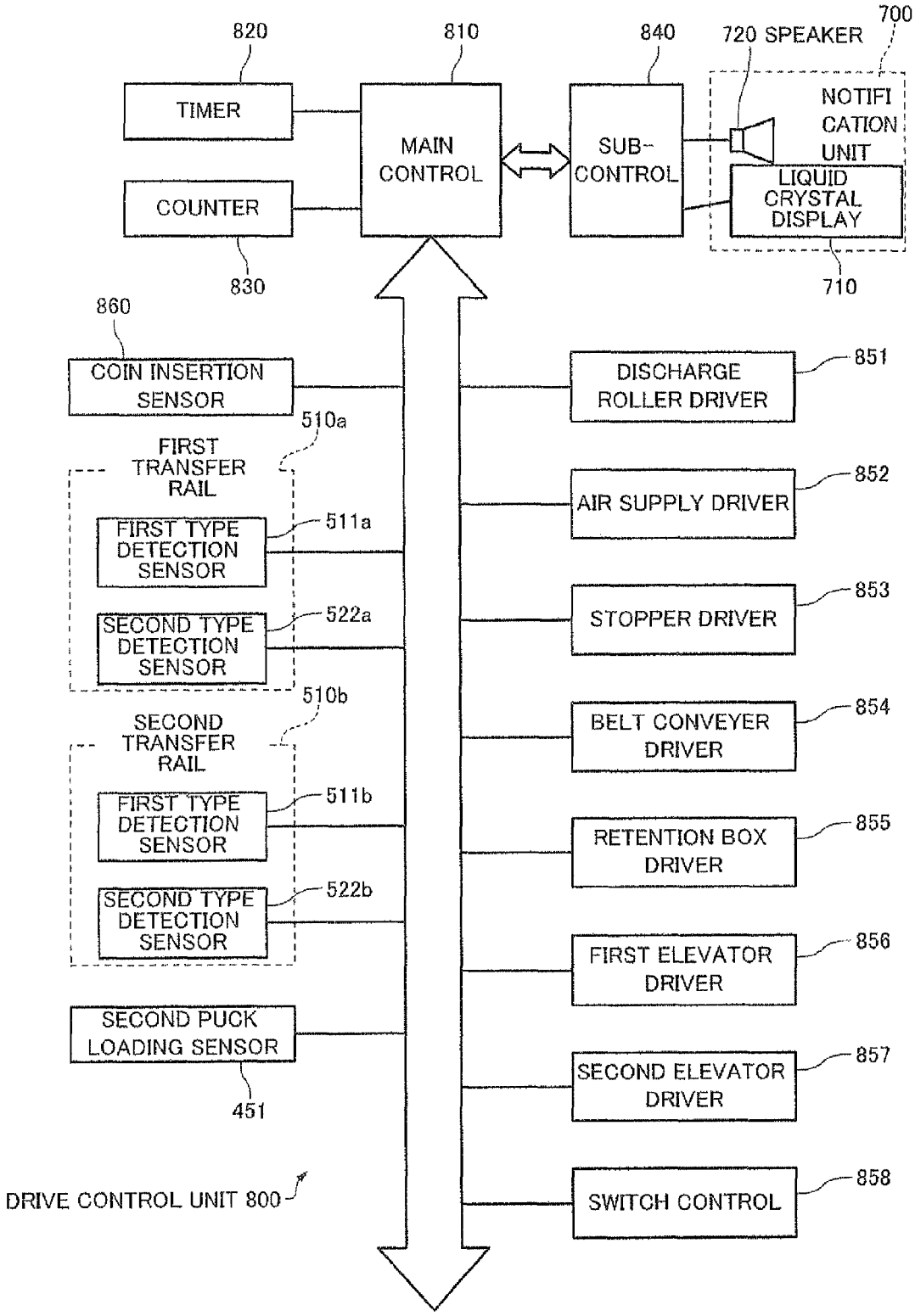
FIG. 8 is a configuration diagram illustrating the configuration of the blocks of a drive control unit according to one embodiment of the invention.
Figure 9:
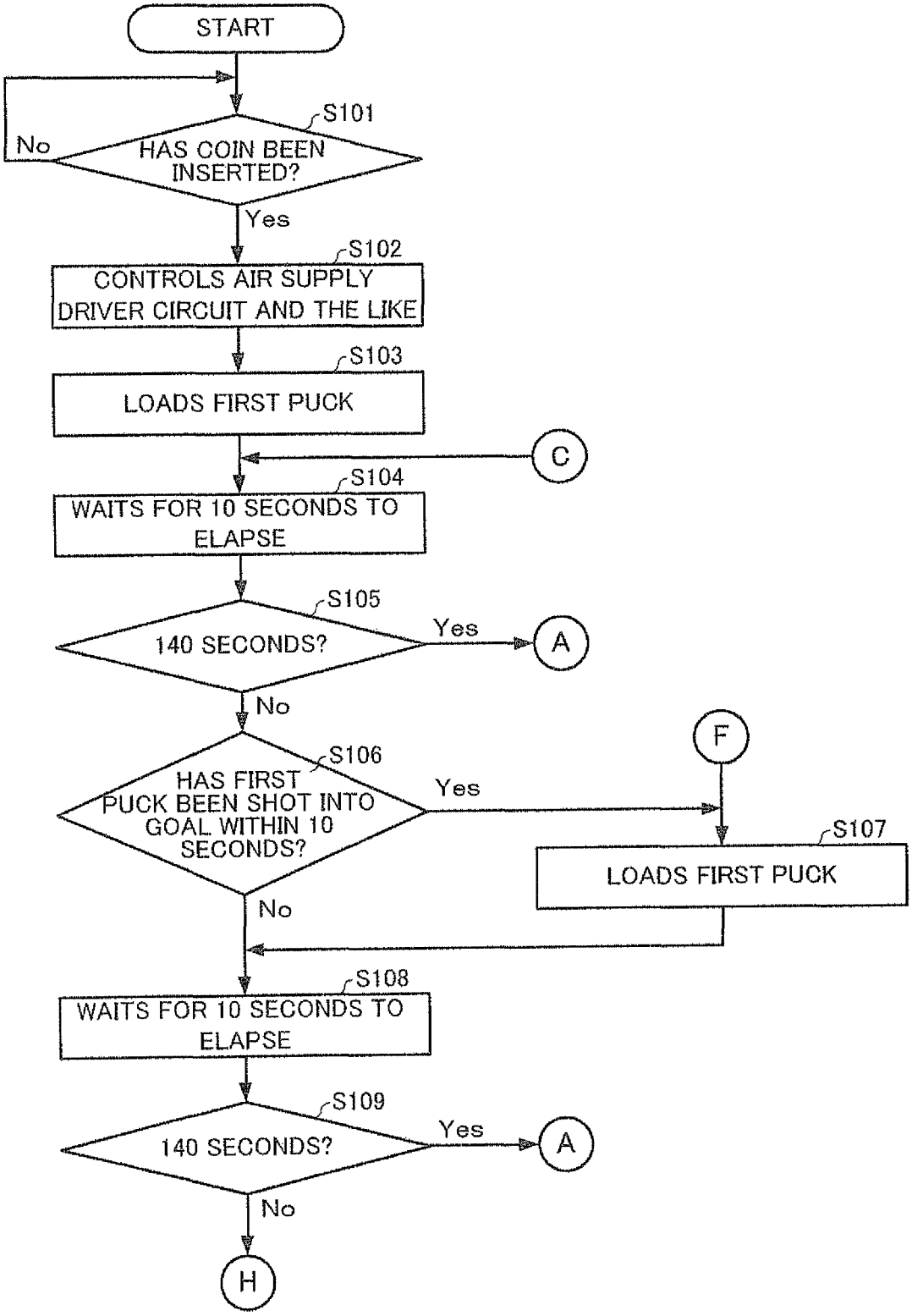
FIG. 9 is a flowchart (I) illustrating the operation of an air hockey game device that implements an air hockey game according to one embodiment of the invention.

As illustrated in FIGS. 5A, 5B, and 8, a first type detection sensor 511*a* and a second type detection sensor 522*a* are provided to the first transfer rail 510*a*, and the first type detection sensor 511*a* and the second type detection sensor 522*a* function as a goal detection unit that detects the first puck 10 and the second puck 20 that have entered the first goal pocket 220*a*.

A first type detection sensor 511*b* and a second type detection sensor 522*b* are provided to the second transfer rail 510*b*, and the first type detection sensor 511*b* and the second type detection sensor 522*b* function as a goal detection unit that detects the first puck 10 and the second puck 20 that have entered the second goal pocket 220*b*.

The collection box 520 is a box for collecting the first puck 10 and the second puck 20 transferred along each transfer rail 510. The collection box 520 is provided inside the housing 200 at the center on the side of the housing 200 opposite to the side on which the loading unit 600 is provided.

The collection box 520 is in the shape of a box of which the upper side is open, and has side surfaces that are respectively bonded to the transfer rails 510. The collection box 520 collects the first puck 10 and the second puck 20 transferred along each transfer rail 510 in a mixed state.

The belt conveyer 530 is disposed from one side surface of the collection box 520 toward the center of the housing 200 in the long side direction (toward the center of the housing 200 along the short side direction). The belt conveyer 530 is a transfer unit that transfer the first puck 10 and the second puck 20 from the collection box 520 to the loading unit 600.

The belt conveyer 530 is driven during the game under control of the drive control unit 800. The belt conveyer 530 sequentially transfers the first puck 10 and the second puck 20 from a position (first transfer point) inside the collection box 520 to a position (second transfer point) which is higher than the position inside the collection box 520 and at which the starting point of a puck sort-out rail 630 of the loading unit 600 is formed.

The first puck 10 and the second puck 20 are placed on the upper side of the belt conveyer 530 so that the disc surface of the first puck 10 and the second puck 20 faces obliquely upward with respect to the field board 210.

The belt conveyer 530 is formed so that the first puck 10 and the second puck 20 are slidably loaded into the puck sort-out rail 630 due to their weight at the end point of the belt conveyer 530.

A plurality of protrusion members 531 is provided on the upper side of the belt conveyer 530 at given intervals. Specifically, the protrusion members 531 are formed to have a given height at given intervals (e.g., at intervals longer to some extent than the diameter of the first puck 10).

Each protrusion member 531 has a height that is equal to or larger than the thickness of the first puck 10 and is less than the total thickness of two second pucks 20. Each protrusion member 531 prevents movement of the first puck 10 or the second puck 20 from the upstream side to the downstream side, or prevents falling of the first puck 10 or the second puck 20 when transferring the first puck 10 and the second puck 20 placed on the upper side of the belt conveyer 530.

According to the above configuration, when a plurality of pucks is placed on the upper side of the belt conveyer 530 in a stacked state, the protrusion member 531 does not hold the upper puck without functioning as a stopper, and the upper puck is collected into the collection box 520 during transfer due to the difference in height. Specifically, the belt conveyer 530 is formed so that the first puck 10 and the second puck 20 can be transferred while separating the pucks.

Loading Unit

The structure of the loading unit 600 according to one embodiment of the invention is described below with reference to FIGS. 6A, 6B, and 7. FIGS. 6A and 6B are rear perspective views illustrating the rear side of the loading unit 600 according to one embodiment of the invention, and FIG. 7 is a rear view illustrating part of the rear side of the loading unit 600 according to one embodiment of the invention.

As illustrated in FIGS. 6A, 6B, and 7, the loading unit 600 includes the first slider 610, the second slider 620, the puck sort-out rail 630, a retention box 640, a first elevator 650, and a second elevator 660. The first elevator 650 and the second elevator 660 implement an elevator mechanism.

The puck sort-out rail 630 is a guide rail for transferring the first puck 10 and the second puck 20 transferred by the collection/transfer unit 500 while sorting and rotating the first puck 10 and the second puck 20.

The puck sort-out rail 630 includes a rail that is formed to be slightly wider than the disc thickness of the first puck 10 and the second puck 20, and a guide that is provided on each side of the rail, and has a height equal to or larger than the diameter of the first puck 10, in the same manner as the transfer rail 510.

The starting point of the puck sort-out rail 630 is formed at the position of the end point of the belt conveyer 530 of the collection/transfer unit 500. The first puck 10 or the second puck 20 transferred by the belt conveyer 530 is rotatably loaded into the starting point of the puck sort-out rail 630.

Specifically, the starling point of the puck sort-out rail 630 is formed at the position at which the circumferential surface of the first puck 10 and the second puck 20 discharged from the belt conveyer 530 comes in contact with the rail surface, and is fitted between the guides on the rail side.

The puck sort-out rail 630 has a given difference in height between the starting point position and the entrance of the first elevator 650. Specifically, the first puck 10 and the second puck 20 rotate and are transferred from the starting point to the entrance of the first elevator 650 that is formed at a position lower than the starting point.

The puck sort-out rail 630 is formed so that the second puck 20 is guided to the retention box 640, and the first puck 10 is loaded into the entrance of the first elevator 650.

As illustrated in FIG. 6B, an elliptical hole 631 is formed in the puck sort-out rail 630 in order to guide the second puck 20 to the retention box 640 during transfer.

The elliptical hole 631 is formed in one of the guides of the puck sort-out rail 630 at a height that is equal to or larger than the disc diameter of the second puck 20 and is less than the disc diameter of the first puck 10. The elliptical hole 631 has a given length in the direction in which the rail extends.

The elliptical hole 631 is formed at a given position of the rail over the retention box 640. A guide member (not illustrated in the drawings) that guides the puck that passes by to the elliptical hole 631 is formed on the side of the rail opposite to the side in which the elliptical hole 631 is formed.

According to the above configuration, the second puck 20 falls from the elliptical hole 631 into the retention box 640, and the first puck 10 passes by the elliptical hole 631 without falling, and reaches the entrance of the first elevator 650 (i.e., reaches the end point).

The retention box 640 is a box that retains the second puck 20. The retention box 640 is formed under the elliptical hole 631 that is formed in one of the guides of the puck sort-out rail 630, and retains the second puck 20 that has fallen from the elliptical hole 631.

The retention box 640 retains a number of second pucks 20, and loads the second puck 20 into the second elevator 660. The retention box 640 has a stirring mechanism for stirring the second pucks 20 retained therein under control of the drive control unit 800 so that the second pucks 20 can be easily loaded, and jamming can be prevented.

The first elevator 650 is formed upright from the end point of the puck sort-out rail 630. The first elevator 650 is a unit that transfers the first puck 10 from the lower side of the housing 200 to the supply unit 400 that is formed on the upper side of the housing 200.

The first elevator 650 has a retention function, and loads the first puck 10 into the supply unit 400 via the first slider 610 under control of the drive control unit 800.

The first elevator 650 includes a transfer unit that sequentially transfers the first puck 10 at given intervals. The transfer unit loads and transfers the first puck 10 while maintaining the state of the first puck 10 transferred by the puck sort-out rail.

The first elevator 650 repeatedly stops and operates under control of the drive control unit 800, and supplies the first puck 10 to the first slider 610 at a given timing.

For example, the first elevator 650 is configured to supply the first puck 10 held by the uppermost transfer unit to the first slider 610 when the first puck 10 has been shot into a goal so that the disc surface of the first puck 10 faces obliquely upward.

The second elevator 660 is a unit that transfers the second puck 20 from the retention box 640 to the supply unit 400 that is formed on the upper side of the housing 200. The second elevator 660 is an elevator mechanism that differs from the first elevator 650. The second elevator 660 loads the second puck 20 into the supply unit 400 via the second slider 620 under control of the drive control unit 800.

Specifically, the second elevator 660 (not illustrated in FIGS. 6A and 6B) includes a transfer unit that transfers a given number of (one set of) second pucks 20 at given intervals.

The second elevator 660 repeatedly stops and operates under control of the drive control unit 800, transfers the second puck 20 from the retention box 640 at a given timing, and supplies one set of second pucks 20 to the second slider 620.

For example, the second elevator 660 operates when the second puck 20 has been supplied from the supply unit 400, and supplies the second puck 20 retained in the retention box 640 to the second slider 620 until a given number is reached so that the disc surface of the second puck 20 faces obliquely upward.

The second elevator 660 stops under control of the drive control unit 800 when a desired number of second pucks 20 (one set of second pucks 20) have been loaded into the supply unit 400.

The first slider 610 is a unit that slides the first puck 10 transferred by the first elevator 650, and loads the first puck 10 into the supply unit 400.

The first slider 610 is formed from the end point of the first elevator 650, and is bonded to the supply unit 400. The first slider 610 loads the first puck 10 discharged from the first elevator 650 into the supply unit 400 so that the disc surface of the first puck 10 faces obliquely upward.

The second slider 620 is a unit that slides one set of second pucks 20 transferred by the second elevator 660, and loads the second pucks 20 into the supply unit 400.

The second slider 620 is formed from the end point of the second elevator 660, and is bonded to the supply unit 400. The second slider 620 loads the second puck 20 discharged from the second elevator 660 into the supply unit 400 so that the disc surface of the second puck 20 faces obliquely upward.

Drive Control Unit

The configuration of the drive control unit 800 according to one embodiment of the invention is described below with reference to FIG. 8. FIG. 8 is a configuration diagram illustrating the configuration of the blocks of the drive control unit 800 according to one embodiment of the invention.

As illustrated in FIG. 8, the drive control unit 800 includes a main control circuit 810, a timer circuit 820, a counter circuit 830 that performs a given count operation, and a sub-control circuit 840 as a control section.

The drive control unit 800 includes a discharge roller driver circuit 851, an air supply driver circuit 852, a stopper driver circuit 853, a belt conveyer driver circuit 854, a retention box driver circuit 855, a first elevator driver circuit 856, a second elevator driver circuit 857, and a switch control circuit 858 that controls the path switch movable member 443 as a control section for driving the discharge roller 224, each section of the supply unit 400, the air supply unit 330, the belt conveyer 530, and the path switch movable member 443.

The main control circuit 810 is implemented by a CPU, a ROM, a RAM, and a hard disk. The main control circuit 810 integrally controls the game process and the like when executing the air hockey game.

More specifically, a coin insertion sensor 860 that detects a coin inserted by the player, the first type detection sensor 511 and the second type detection sensor 522 that are provided corresponding to each transfer rail 510, and the second puck loading sensor 451 provided to the supply unit 400 are connected to the input port of the main control circuit 810.

The main control circuit 810 (1) performs a game start control process and a game end control process, and controls the air supply driver circuit 852, the belt conveyer driver circuit 854, and the retention box driver circuit 855 based on the game start control process and the game end control process, (2) detects the elapsed time from the supply of the first puck 10 in cooperation with the timer circuit 820, (3) measures a predetermined time (e.g., 10 seconds or 20 seconds) in cooperation with the timer circuit 820, (4) detects whether or not the first puck 10 or the second puck 20 has been shot into a goal based on an output signal from the first type detection sensor 511 and an output signal from the second type detection sensor 522, and counts the number of goals in cooperation with the counter circuit 830, (5) counts the score obtained by shooting the first puck 10 and the second puck 20 into a goal based on an output signal from the first type detection sensor 511 and an output signal from the second type detection sensor 522 in cooperation with the counter circuit 830, (6) counts the number of times that a given process has been performed in cooperation with the counter circuit 830, (7) controls the first elevator driver circuit 856 for loading the first puck 10, and controls the path of the first puck 10, (8) counts the number of first pucks 10 loaded after the game started in cooperation with the counter circuit 830, and (9) counts the number of second pucks 20 loaded in cooperation with the counter circuit 830, controls the second elevator driver circuit 857 for loading the second puck 20, and controls the stopper driver circuit 853, based on a signal output from each sensor.

When determining the type of the goal pocket 220, and counting the number of respective pucks shot into a goal, when the main control circuit 810 has almost simultaneously detected the signal from the first type detection sensor 511 and the signal from the second type detection sensor 522, the main control circuit 810 determines that the first puck 10 has entered the goal pocket 220 corresponding to the sensor that has output the signal.

When the main control circuit 810 has detected only the signal from second type detection sensor 522, the main control circuit 810 determines that the second puck 20 has entered the goal pocket 220. The main control circuit 810 performs the count operation each time it has been determined that the puck has entered each goal pocket 220.

The sub-control circuit 840 includes a sub-CPU, a sound source IC, a power amplifier, and a display control circuit. The sub-control circuit 840 controls the liquid crystal display 710 and the speaker 720 of the notification unit 700.

The sub-control circuit 840 controls the sound source IC and the display control circuit based on the score calculated by the main control circuit 810 each time the puck has entered the goal pocket 220 to output a predetermined sound through each speaker 720, and display an image (e.g., score image or given image) specified by a program.

The timer circuit 820 performs a first measurement and a second measurement described later.

The counter circuit 830 counts the number of first pucks 10 loaded, the number of first pucks 10 that have been shot into each goal pocket 220, the number of second pucks 20 that have been shot into each goal pocket 220, the number of first pucks 10 that have been shot into each goal pocket 220 at an early stage (e.g., the number of first pucks 10 that have been shot into each goal pocket 220 within 10 seconds after loading), and the number of times that a given process has been performed.

Air Hockey Game

The air hockey game according to one embodiment of the invention is described below with reference to FIGS. 9 to 14. FIGS. 9 to 14 are flowcharts illustrating the operation of the air hockey game device 100 that implements the air hockey game according to one embodiment of the invention.

<Outline of Game>

The air hockey game according to one embodiment of the invention includes (1) a normal game that allows the player to play the game using one first puck 10 immediately after the game has started (steps S103 to S110), (2) a special game that allows the player to play the game using two or more first pucks 10 (step S110 (No)→step S112 (No)→step S118 (No)→step S155), (3) a panic game that allows the player to play the game using one or more first pucks 10 and a plurality of second pucks 20 (step S112 (Yes)→step S114, step S118 (Yes)→step S121, step S110 (Yes)→step S254 or step S209), and (4) an ending game that allows the player to play an exciting game by supplying a large number of second pucks 20 together with the first puck 10 (step S300 to step S305 or step S308).

In the special game, when the first puck 10 has not been shot into a goal within a given time each time the first puck 10 has been supplied, an additional first puck 10 is supplied.

The drive control unit 800 provides each game by appropriately loading the first puck 10 or supplying the second puck 20 when a given condition has been satisfied, or a given timing has been reached.

For example, the drive control unit 800 estimates that a skilled player successively makes a goal immediately after the first puck has been loaded when the difference in skill between the players is large, and changes the game mode to the panic game in order to change the game playability.

When a monotonous game situation has continued (e.g., when the first puck 10 has not been shot into a goal for a long time), the drive control unit 800 changes the game mode to the panic game in order to change the game playability.

The drive control unit 800 detects the end timing of the panic game and the start timing of the ending game.

The drive control unit 800 appropriately changes the game mode based on (1) whether or not the first puck 10 has been shot into a goal, (2) the number of second pucks 20 that have been shot into a goal, (3) whether or not the first puck 10 has been shot into a goal within 10 or 20 seconds after the first puck 10 has been loaded, and the goal continuity, (4) whether or not 140 seconds has elapsed after the first puck 10 has been initially loaded, and (5) the goal history of the first puck 10 that has been shot into the goal pocket 220 (i.e., the time from the timing when the first puck 10 has been loaded to the timing when the first puck 10 has been shot into a goal, and the type of the goal pocket 220).

More specifically, the drive control unit 800 cooperates with the timer circuit 820 to perform the first measurement that measures 140 seconds (step S102 to step S105, step S109 to step S117 or step S120), and the second measurement that measures 10 seconds or 20 seconds (step S104 to step S106, step S108 to step S110, step S116 to step S118, step S154 to step S155 (10-second measurement), or steps S151 and S152, steps S301 and S302 (20-second measurement)).

When a new second measurement has started during the second measurement, the timer circuit 820 stores the measured time and the type of the goal pocket 220 in the main control circuit 810, resets the measured time, and measures the time again.

The measured time and the type of the goal pocket 220 stored in the main control circuit 810 are used as the goal history (reference) for determining the difference in skill between the players, and changing the game mode to the panic game.

The counter circuit 830 counts the number of first pucks 10 that have been shot into each goal pocket 220, the number of first pucks 10 that have been shot into each goal pocket 220 at an early stage (step S201), the number of times that a given process has been performed (steps S111 and S112, steps S205 and S206, steps S212 and S213), and the number of second pucks 20 that have been shot into each goal pocket 220 (step S114, step S208, step S211, step S253, step S256).

<Initial Setting of Air Hockey Game>

The first pucks 10 have been loaded into each transfer unit of the first elevator 650, and the maximum number of second pucks 20 have been loaded into the second supply section 450 before the game starts. One of the independent paths 441 (e.g., the final path used in the previous game) has been selected by the path switch movable member 443.

<Air Hockey Game Implemented by Air Hockey Game Device>

(1) Start of Game and Normal Game (1-1) Game Start Process (Steps S101 and S102)

When a coin insertion signal (that indicates that a coin has been inserted) has been input to the main control circuit 810 from the coin insertion sensor 860 (step S101), the main control circuit 810 starts to control the air supply driver circuit 852, the belt conveyer driver circuit 854, and the retention box driver circuit 855. starts the first measurement, and resets the counter to start the game (step S102).

Specifically, the main control circuit 810 drives the air supply unit 330 to discharge air from the air holes 211 formed in the field board 210, and drives the belt conveyer 530 and the retention box 640. The main control circuit 810 causes the timer circuit 820 to start the first measurement, and rests each counter of the counter circuit 830.

(1-2) Normal Game (Step S103 to Step S110)

The main control circuit 810 controls the first elevator driver circuit 856, and loads the uppermost first puck 10 from the first elevator 650 into the supply unit 400 (step S103).

When the first puck 10 has been loaded into the supply unit 400, the first puck 10 slides along the independent path 441 selected in advance, and is supplied to the field board 210 toward one of the players.

The first elevator 650 moves the transfer unit upward by one stage. Specifically, the first elevator 650 moves the second highest transfer unit upward in order to subsequently load the first puck 10 into the supply unit 400. The main control circuit 810 adds "1" to the first puck loading counter.

The main control circuit 810 causes the timer circuit 820 to start the second measurement, and waits for 10 seconds to elapse (step S104). The main control circuit 810 then determines whether or not the result of the first measurement performed by the timer circuit 820 is 140 seconds (step S105).

Figure 14:
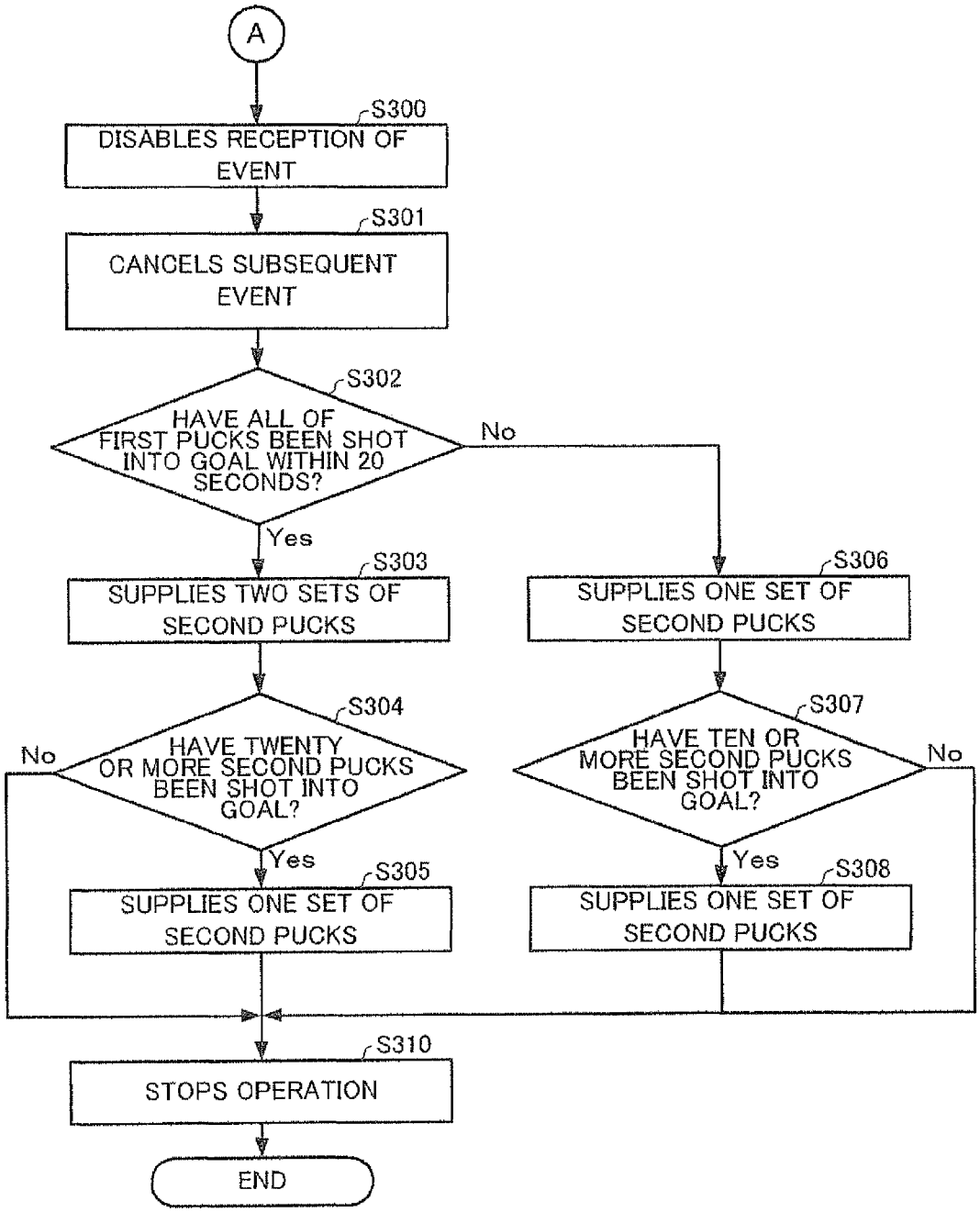
FIG. 14 is a flowchart (VI) illustrating the operation of an air hockey game device that implements an air hockey game according to one embodiment of the invention.

When the main control circuit 810 has determined that the result of the first measurement is not 140 seconds, the step S106 is performed. When the main control circuit 810 has determined that the result of the first measurement is 140 seconds, the step S300 in FIG. 14 is performed (i.e., the game mode is changed to the ending game).

The main control circuit 810 then determines whether or not the first puck 10 has been shot into one of the goal pockets 220 within 10 seconds measured by the second measurement (step S106).

When the main control circuit 810 has determined that the first puck 10 has not been shot into the goal pockets 220 within 10 seconds, the step S108 is performed.

When the main control circuit 810 has determined that the first puck 10 has been shot into one of the goal pockets 220 within 10 seconds, the main control circuit 810 controls the first elevator driver circuit 856, and loads the uppermost first puck 10 from the first elevator 650 into the supply unit 400 (step S107). The step S108 is then performed.

In the step S107, the main control circuit 810 controls the switch control circuit 858, and switches or maintains the path using the path switch movable member 443 so that the first puck 10 is supplied to the player who has conceded a goal.

When the first puck 10 has been loaded into the supply unit 400, the first puck 10 slides along the independent path 441 selected in advance, and is supplied to the field board 210 toward the player.

The first elevator 650 moves the transfer unit upward by one stage. Specifically, the first elevator 650 moves the second highest transfer unit upward in order to subsequently load the first puck 10 into the supply unit 400. The main control circuit 810 adds "1" to the first puck loading counter.

Figure 12:
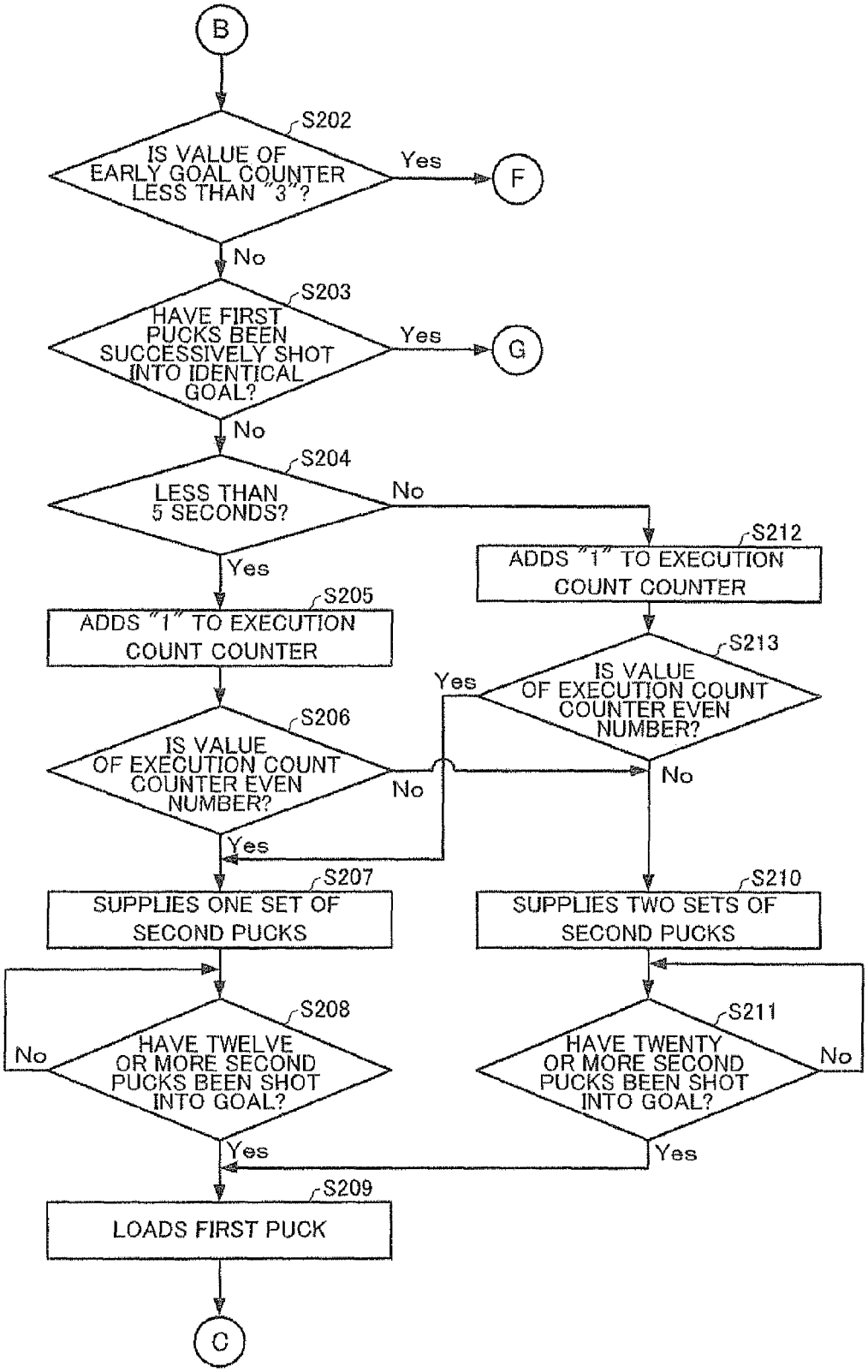
FIG. 12 is a flowchart (IV) illustrating the operation of an air hockey game device that implements an air hockey game according to one embodiment of the invention.
Figure 13:
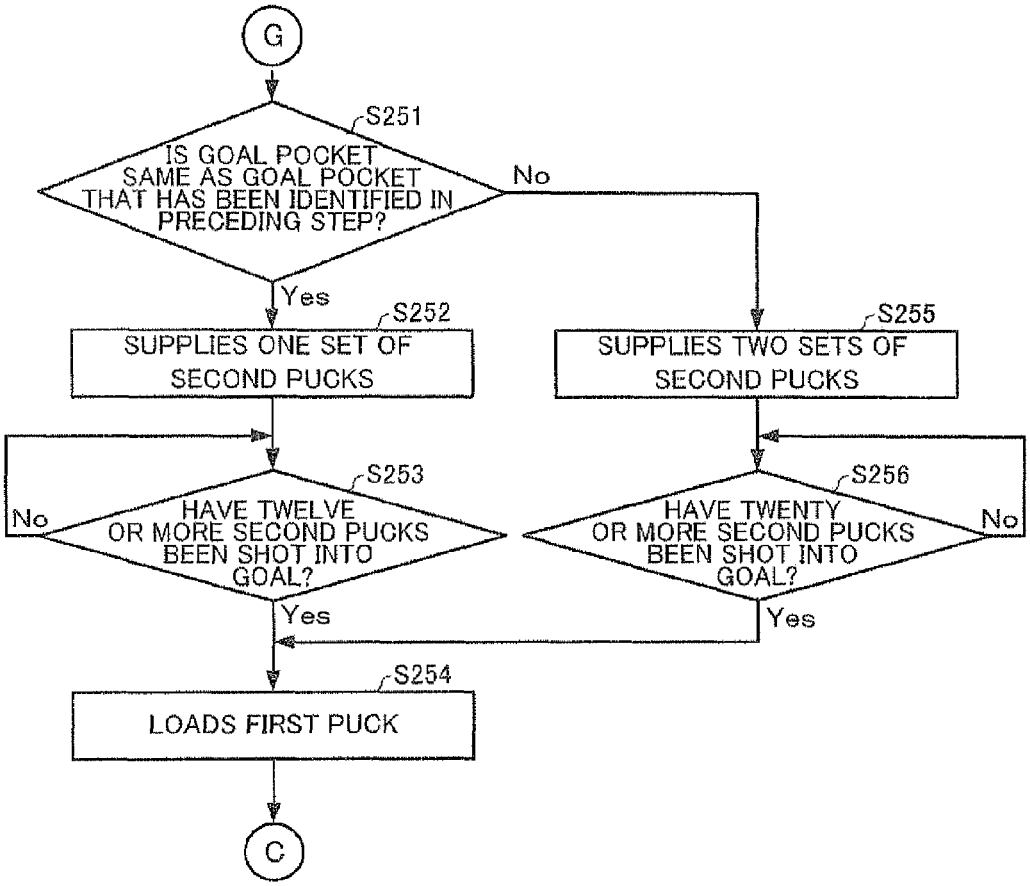
FIG. 13 is a flowchart (V) illustrating the operation of an air hockey game device that implements an air hockey game according to one embodiment of the invention.

Note that the step S107 is also performed when it has been determined that the value of the early-stage goal counter is less than "3" (i.e., the normal game is maintained) in the step S202 in FIG. 12.

In the step S108, the main control circuit 810 causes the timer circuit 820 to start the second measurement, and waits for 10 seconds to elapse. The main control circuit 810 then determines whether or not the result of the first measurement performed by the timer circuit 820 is 140 seconds (step S109).

Figure 10:
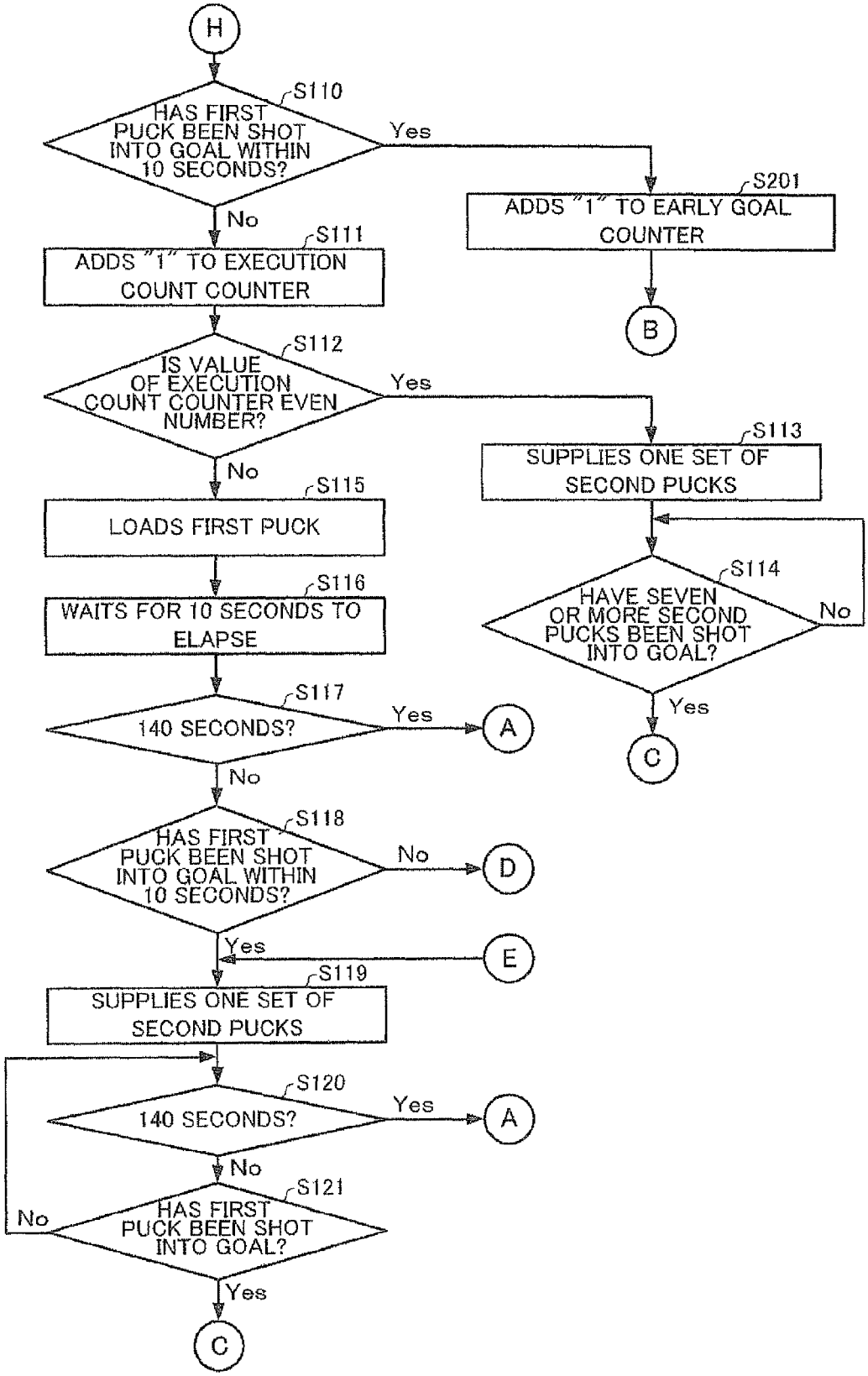
FIG. 10 is a flowchart (II) illustrating the operation of an air hockey game device that implements an air hockey game according to one embodiment of the invention.
Figure 11:
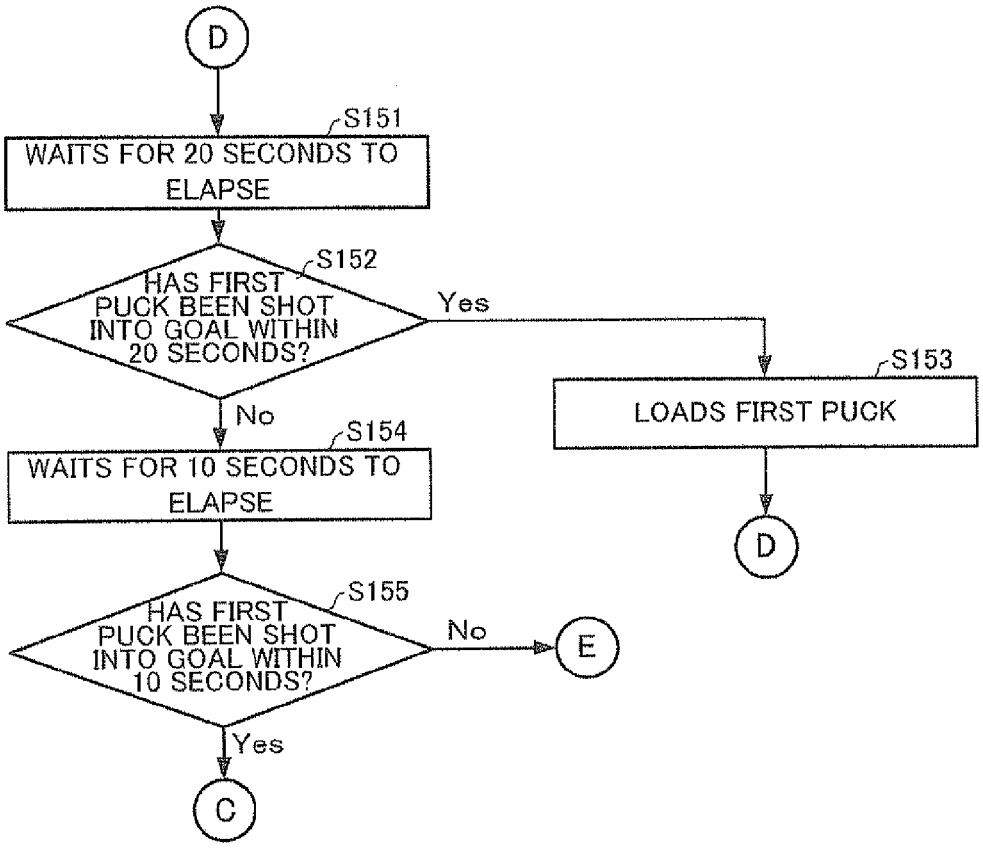
FIG. 11 is a flowchart (III) illustrating the operation of an air hockey game device that implements an air hockey game according to one embodiment of the invention.

When the main control circuit 810 has determined that the result of the first measurement is not 140 seconds, the step S110 in FIG. 10 is performed. When the main control circuit 810 has determined that the result of the first measurement is 140 seconds, the step S300 in FIG. 14 is performed (i.e., the game mode is changed to the ending game).

The main control circuit 810 then determines whether or not the first puck 10 has been shot into one of the goal pockets 220 within 10 seconds measured by the second measurement (step S110) (see FIG. 10).

When the main control circuit 810 has determined that the first puck 10 has not been shot into the goal pockets 220 within 10 seconds, the step S111 is performed in order to change the game mode to the special game.

When the main control circuit 810 has determined that the first puck 10 has not been shot into the goal pockets 220 within 10 seconds, the step S201 is performed in order to determine whether or not the difference in skill between the players is large. When it has been determined that the difference in skill between the players is large based on the goal history, the game mode is changed to the panic game (step S201 to step S254 or step S209) (see FIG. 12).

(2) Special Game (Step S110 (No) to Step S155)

When the main control circuit 810 has determined that the first puck 10 has not been shot into the goal pockets 220 within 10 seconds in the step S110, the main control circuit 810 adds "1" to the execution count counter (step S111).

The main control circuit 810 then determines whether or not the value of the execution count counter is an even number (step S112). When the main control circuit 810 has determined that the value of the execution count counter is not an even number, the step S115 is performed, and the game mode is changed to the special game.

When the main control circuit 810 has determined that the value of the execution count counter is an even number, the step S113 is performed, and the game mode is changed to the panic game.

When the main control circuit 810 has determined that the value of the execution count counter is not an even number in the step S112, the main control circuit 810 controls the first elevator driver circuit 856, and loads the uppermost first puck 10 from the first elevator 650 into the supply unit 400 (step S115).

The main control circuit 810 controls the switch control circuit 858, and switches or maintains the path using the path switch movable member 443 so that the first puck 10 is supplied to the player who has conceded a goal.

When the first puck 10 has been loaded into the supply unit 400, the first puck 10 slides along the independent path 441 selected in advance, and is supplied to the field board 210 toward the player. The main control circuit 810 adds "1" to the first puck loading counter.

The main control circuit 810 causes the timer circuit 820 to start the second measurement, and waits for 10 seconds to elapse (step S116). The main control circuit 810 then determines whether or not the result of the first measurement performed by the timer circuit 820 is 140 seconds (step S117).

When the main control circuit 810 has determined that the result of the first measurement is not 140 seconds, the step S118 is performed. When the main control circuit 810 has determined that the result of the first measurement is 140 seconds, the step S300 in FIG. 14 is performed (i.e., the game mode is changed to the ending game).

The main control circuit 810 then determines whether or not the first puck 10 has been shot into one of the goal pockets 220 within 10 seconds measured by the second measurement (step S118).

When the main control circuit 810 has determined that the first puck 10 has not been shot into the goal pockets 220 within 10 seconds, the step S151 (see FIG. 11) is performed.

When the main control circuit 810 has determined that the first puck 10 has been shot into one of the goal pockets 220 within 10 seconds, the step S119 is performed, and the game mode is changed to the panic game.

When the main control circuit 810 has determined that the first puck 10 has not been shot into the goal pockets 220 within 10 seconds in the step S118, the main control circuit 810 causes the timer circuit 820 to start the second measurement, and waits for 20 seconds to elapse (step S151). The main control circuit 810 then determines whether or not the first puck 10 has been shot into one of the goal pockets 220 within 20 seconds (step S152).

Specifically, the main control circuit 810 determines whether or not the counter value that indicates the number of first pucks 10 shot into each goal pocket 220 has been incremented by "1" after the step S118.

When the main control circuit 810 has determined that the first puck 10 has been shot into one of the goal pockets 220 within 20 seconds, the step S153 is performed.

When the main control circuit 810 has determined that the first puck 10 has not been shot into the goal pockets 220 within 20 seconds, the step S154 is performed.

When the main control circuit 810 has determined that the first puck 10 has been shot into one of the goal pockets 220 within 20 seconds in the step S152, the main control circuit 810 controls the first elevator driver circuit 856, and loads the uppermost first puck 10 from the first elevator 650 into the supply unit 400 (step S153). The step S151 is then performed.

The main control circuit 810 controls the switch control circuit 858, and switches or maintains the path using the path switch movable member 443 so that the first puck 10 is supplied to the player who has conceded a goal.

When the first puck 10 has been loaded into the supply unit 400, the first puck 10 slides along the independent path 441 selected in advance, and is supplied to the field board 210 toward the player. The main control circuit 810 adds "1" to the first puck loading counter.

When the main control circuit 810 has determined that the first puck 10 has not been shot into the goal pockets 220 within 20 seconds in the step S152, the main control circuit 810 causes the timer circuit 820 to start the second measurement, and waits for 10 seconds to elapse (step S154). The main control circuit 810 then determines whether or not the first puck 10 has been shot into one of the goal pockets 220 within 10 seconds (step S155).

When the main control circuit 810 has determined that the first puck 10 has been shot into one of the goal pockets 220 within 10 seconds in the step S155, the step S104 (see FIG. 9) is performed.

When the main control circuit 810 has determined that the first puck 10 has not been shot into the goal pockets 220 within 10 seconds, the step S119 is performed, and the game mode is changed to the panic game.

When the step S104 is performed after the step S155 during the special game, the steps S112 to S104 are performed in the special game (i.e., the game mode is not changed to the normal game).

(3) Panic Game (3-1) Panic Game (1) (Steps S113 and S114)

When the main control circuit 810 has determined that the value of the execution count counter is an even number in the step S112, the main control circuit 810 controls the stopper driver circuit 853 to open the lowermost stopper 452 to supply one set of second pucks 20 (e.g., fifteen second pucks 20) to the field board 210, and changes the game mode to the panic game (step S113).

When all of the second pucks 20 retained by the lowermost stopper 452 have been supplied to the field board 210, the main control circuit 810 closes the lowermost stopper 452, and controls the open state and the closed state of the remaining stoppers 452 while controlling the second elevator driver circuit 857 to sequentially load the second puck 20 into the lowermost stopper 452 and the remaining stoppers 452.

The main control circuit 810 then determines whether or not seven or more second pucks 20 have been shot into each goal pocket 220 after the step S113 based on each counter that counts the number of second pucks 20 that have been shot into a goal (step S114). When the main control circuit 810 has determined that seven or more second pucks 20 have been shot into each goal pocket 220, the step S104 is performed in order to change the game mode to the normal game or the special game.

In the step S114, whether or not 10 seconds has elapsed after supplying the second puck 20 may be determined.

(3-2) Panic Game (2) (Steps S119 and S121)

When the main control circuit 810 has determined that the first puck 10 has been shot into one of the goal pockets 220 within 10 seconds in the step S118, or has determined that the first puck 10 has not been shot into the goal pockets 220 within 10 seconds in the step S155, the main control circuit 810 controls the stopper driver circuit 853 to open the lowermost stopper 452 to supply one set of second pucks 20 (e.g., fifteen second pucks 20) to the field board 210 (step S119).

When all of the second pucks 20 retained by the lowermost stopper 452 have been supplied to the field board 210, the main control circuit 810 closes the lowermost stopper 452, and controls the open state and the closed state of the remaining stoppers 452 while controlling the second elevator driver circuit 857 to sequentially load the second puck 20 into the lowermost stopper 452 and the remaining stoppers 452.

The main control circuit 810 then determines whether or not the result of the first measurement performed by the timer circuit 820 is 140 seconds (step S120). When the main control circuit 810 has determined that the result of the first measurement is not 140 seconds, the step S121 is performed.

When the main control circuit 810 has determined that the result of the first measurement is 140 seconds, the step S300 in FIG. 14 is performed (i.e., the game mode is changed to the ending game).

The main control circuit 810 then determines whether or not the two first pucks 10 present on the field board 210 have been shot into one of the goal pockets 220 based on the output signal from the first type detection sensor 511 (step S121).

Specifically, the main control circuit 810 determines whether or not the counter value that indicates the number of first pucks 10 shot into each goal pocket 220 has been incremented by "1" after the step S120.

When the main control circuit 810 has determined that one of the two first pucks 10 has been shot into one of the goal pockets 220, the step S104 is performed. When the main control circuit 810 has determined that the two first pucks 10 have not been shot into the goal pockets 220, the step S120 is performed. Note that the step S104 is performed in a state in which the game mode is set to the normal game or the special game.

(3-3) Panic Game (3) (Steps S201 and S209)

When the main control circuit 810 has determined that the first puck 10 has been shot into one of the goal pockets 220 within 10 seconds in the step S110, the main control circuit 810 adds "1" to the early goal counter while linking the value to the type of the goal pocket 220 (step S201).

The main control circuit 810 then determines whether or not the value of the early goal counter is less than "3" (step S202) (see FIG. 12). When the main control circuit 810 has determined that the value of the early goal counter is less than "3", the step S107 is performed. Note that the step S107 is performed in a state in which the game mode is set to the normal game or the special game.

When the main control circuit 810 has determined that the value of the early goal counter is equal to or larger than "3", the main control circuit 810 determines whether or not three first pucks 10 have been successively shot into an identical goal pocket 220 (step S203).

When the main control circuit 810 has determined that the three first pucks 10 have been shot into an identical goal pocket 220, the step S251 (see FIG. 13) is performed. When the main control circuit 810 has determined that the three first pucks 10 have not been successively shot into an identical goal pocket 220, the step S204 is performed.

The main control circuit 810 then determines whether or not the result of the second measurement was less than 5 seconds when the three first pucks 10 were shot into the goal pocket 220 (step S204).

When the main control circuit 810 has determined that the result of the second measurement was less than 5 seconds when the three first pucks 10 were shot into the goal pocket 220 based on the goal history, the step S205 is performed. When the main control circuit 810 has determined that the result of the second measurement was not less than 5 seconds when the three first pucks 10 were shot into the goal pocket 220, the step S212 is performed.

When the main control circuit 810 has determined that the result of the second measurement was less than 5 seconds when the three first pucks 10 were shot into the goal pocket 220, the main control circuit 810 adds "1" to the execution count counter (counter that differs from that of the step S111) (step S205), and determines whether or not the value of the execution count counter is an even number (step S206).

When the main control circuit 810 has determined that the value of the execution count counter is an even number, the step S207 is performed. When the main control circuit 810 has determined that the value of the execution count counter is not an even number, the step S210 is performed.

When the main control circuit 810 has determined that the value of the execution count counter is an even number in the step S206, the main control circuit 810 controls the stopper driver circuit 853 to open the lowermost stopper 452 to supply one set of second pucks 20 (e.g., fifteen second pucks 20) to the field board 210 (step S207).

When all of the second pucks 20 retained by the lowermost stopper 452 have been supplied to the field board 210, the main control circuit 810 closes the lowermost stopper 452, and controls the open state and the closed state of the remaining stoppers 452 while controlling the second elevator driver circuit 857 to sequentially load the second puck 20 into the lowermost stopper 452 and the remaining stoppers 452.

The main control circuit 810 then determines whether or not the total number of second pucks 20 that have been shot into the goal pockets 220 after the step S207 has reached 12 based on each second puck goal counter (step S208). When the main control circuit 810 has determined that the total number of second pucks 20 that have been shot into the goal pockets 220 after the step S207 has reached 12, the step S209 is performed. In the step S208, whether or not 15 seconds has elapsed after supplying the second puck 20 may be determined.

When the main control circuit 810 has determined that the total number of second pucks 20 that have been shot into the goal pockets 220 after the step S207 has reached 12 based on each second puck goal counter, the main control circuit 810 controls the first elevator driver circuit 856, and loads the uppermost first puck 10 from the first elevator 650 into the supply unit 400 (step S209). The step S104 is then performed in order to change the game mode to the normal game or the special game.

The main control circuit 810 controls the switch control circuit 858, and switches or maintains the path using the path switch movable member 443 so that the first puck 10 is supplied to the player who has conceded a goal.

When the first puck 10 has been loaded into the supply unit 400, the first puck 10 slides along the independent path 441 selected in advance, and is supplied to the field board 210 toward the player. The main control circuit 810 adds "1" to the first puck loading counter.

When the main control circuit 810 has determined that the value of the execution count counter is not an even number in the step S206, the main control circuit 810 controls the stopper driver circuit 853 to open the lowermost stopper 452 and the second lowest stopper 452 to supply two sets of second pucks 20 (e.g., thirty second pucks 20 (fifteen second pucks 20+fifteen second pucks 20) to the field board 210 (step S210).

When all of the second pucks 20 retained by the lowermost stopper 452 and the second lowest stopper 452 have been supplied to the field board 210, the main control circuit 810 closes the lowermost stopper 452, and controls the open state and the closed state of the remaining stoppers 452 while controlling the second elevator driver circuit 857 to sequentially load the second puck 20 into the lowermost stopper 452 and the remaining stoppers 452.

The main control circuit 810 then determines whether or not the total number of second pucks 20 that have been shot into the goal pockets 220 after the step S210 has reached 20 based on each second puck goal counter (step S211). When the main control circuit 810 has determined that the total number of second pucks 20 that have been shot into the goal pockets 220 after the step S210 has reached 20, the step S209 is performed.

In the step S211, whether or not 20 seconds has elapsed after supplying the second puck 20 may be determined.

When the main control circuit 810 has determined in the step S204 that the result of the second measurement was not less than 5 seconds when the three first pucks 10 were shot into the goal pocket 220, the main control circuit 810 adds "1" to the execution count counter (counter that differs from those of the step S111 and the step S205) (step S212), and determines whether or not the value of the execution count counter is an even number (step S213).

When the main control circuit 810 has determined that the value of the execution count counter is an even number, the step S207 is performed. When the main control circuit 810 has determined that the value of the execution count counter is not an even number, the step S210 is performed.

When the main control circuit 810 has determined that the three first pucks 10 have been shot into an identical goal pocket 220 in the step S203, the main control circuit 810 determines whether or not the identical goal pocket 220 is the same as the goal pocket 220 that has been identified in the preceding step S203 (step S251).

When the main control circuit 810 has determined that the identical goal pocket 220 is the same as the goal pocket 220 that has been identified in the preceding step 5203, the step S252 is performed. When the main control circuit 810 has determined that the identical goal pocket 220 differs from the goal pocket 220 that has been identified in the preceding step S203, the step S255 is performed.

When the main control circuit 810 has determined in the step S251 that the identical goal pocket 220 is the same as the goal pocket 220 that has been identified in the preceding step S203, the main control circuit 810 controls the stopper driver circuit 853 to open the lowermost stopper 452 to supply one set of second pucks 20 (e.g., fifteen second pucks 20) to the field board 210 (step S252).

When all of the second pucks 20 retained by the lowermost stopper 452 have been supplied to the field board 210, the main control circuit 810 closes the lowermost stopper 452, and controls the open state and the closed state of the remaining stoppers 452 while controlling the second elevator driver circuit 857 to sequentially load the second puck 20 into the lowermost stopper 452 and the remaining stoppers 452.

The main control circuit 810 then determines whether or not the total number of second pucks 20 that have been shot into the goal pockets 220 after the step S252 has reached 12 based on each second puck goal counter (step S253). When the main control circuit 810 has determined that the total number of second pucks 20 that have been shot into the goal pockets 220 after the step S252 has reached 12, the step S254 is performed.

In the step S253, whether or not 15 seconds has elapsed after supplying the second puck 20 may be determined.

When the main control circuit 810 has determined in the step S253 that the total number of second pucks 20 that have been shot into the goal pockets 220 after the step S207 has reached 12 based on each second puck goal counter, the main control circuit 810 controls the first elevator driver circuit 856, and loads the uppermost first puck 10 from the first elevator 650 into the supply unit 400 (step S254). The step S104 is then performed in order to change the game mode to the normal game or the special game.

The main control circuit 810 controls the switch control circuit 858, and switches or maintains the path using the path switch movable member 443 so that the first puck 10 is supplied to the player who has conceded a goal.

When the first puck 10 has been loaded into the supply unit 400, the first puck 10 slides along the independent path 441 selected in advance, and is supplied to the field board 210 toward the player. The main control circuit 810 adds "1" to the first puck loading counter.

When the main control circuit 810 has determined in the step S251 that the identical goal pocket 220 differs from the goal pocket 220 that has been identified in the preceding step S203, the main control circuit 810 controls the stopper driver circuit 853 to open the lowermost stopper 452 and the second lowest stopper 452 to supply two sets of second pucks 20 (e.g., thirty second pucks 20 (fifteen second pucks 20+fifteen second pucks 20) to the field board 210 (step S255).

When all of the second pucks 20 retained by the lowermost stopper 452 and the second lowest stopper 452 have been supplied to the field board 210, the main control circuit 810 closes the lowermost stopper 452, and controls the open state and the closed state of the remaining stoppers 452 while controlling the second elevator driver circuit 857 to sequentially load the second puck 20 into the lowermost stopper 452 and the remaining stoppers 452.

The main control circuit 810 then determines whether or not the total number of second pucks 20 that have been shot into the goal pockets 220 after the step S255 has reached 20 based on each second puck goal counter (step S256). When the main control circuit 810 has determined that the total number of second pucks 20 that have been shot into the goal pockets 220 after the step S255 has reached 20, the step S254 is performed, and the first puck 10 is loaded.

In the step S256, whether or not 20 seconds has elapsed after supplying the second puck 20 may be determined.

(4) Ending Game, and End of Game (Step S300 to Step S310)

When the main control circuit 810 has determined that the result of the first measurement is 140 seconds in the step S105, S109, S117, or S120, the main control circuit 810 disables reception of any event (step S300) (see FIG. 14), and performs a setting process for cancelling the subsequent event (step S301). The main control circuit 810 causes the timer circuit 820 to start the second measurement.

The main control circuit 810 then determines the number of first pucks 10 that have been supplied to the field board 210, and have not been shot into a goal, based on the signal from each first type detection sensor 511 and the first puck loading counter, and determines whether or not all of the first pucks 10 have been shot into a goal within 20 seconds after the second measurement has started, based on the signal from each first type detection sensor 511 (step S302).

When the main control circuit 810 has determined that all of the first pucks 10 have been shot into a goal within 20 seconds after the second measurement has started, the step S303 is performed. When the main control circuit 810 has determined that all of the first pucks 10 have not been shot into a goal within 20 seconds after the second measurement has started, the step S306 is performed.

When the main control circuit 810 has determined in the step S302 that all of the first pucks 10 have been shot into a goal within 20 seconds after the second measurement has started, the main control circuit 810 controls the stopper driver circuit 853 to open the lowermost stopper 452 and the second lowest stopper 452 to supply two sets of second pucks 20 (e.g., thirty second pucks 20 (fifteen second pucks 20+fifteen second pucks 20) to the field board 210 (step S303).

When all of the second pucks 20 retained by the lowermost stopper 452 and the second lowest stopper 452 have been supplied to the field board 210, the main control circuit 810 closes the lowermost stopper 452, and controls the open state and the closed state of the remaining stoppers 452 while controlling the second elevator driver circuit 857 to sequentially load the second puck 20 into the lowermost stopper 452 and the remaining stoppers 452. The main control circuit 810 causes the timer circuit 820 to start the second measurement.

The main control circuit 810 then determines whether or not the total number of second pucks 20 that have been shot into the goal pockets 220 after the step S302 has reached 20 within 10 seconds after the second measurement has started, based on each second puck goal counter (step S304).

When the main control circuit 810 has determined that the total number of second pucks 20 that have been shot into the goal pockets 220 after the step S302 has reached 20, the main control circuit 810 controls the stopper driver circuit 853 to open the lowermost stopper 452 to supply the second pucks 20 (e.g., fifteen second pucks 20) to the field board 210 (step S305). The step S310 is then performed.

When the main control circuit 810 has determined in the step S304 that the total number of second pucks 20 that have been shot into the goal pockets 220 after the step S302 has not reached 20 within 10 seconds after the second measurement has started, based on each second puck goal counter, the step S310 is performed.

When the main control circuit 810 has determined in the step S302 that all of the first pucks 10 have not been shot into a goal within 20 seconds after the second measurement has started, the main control circuit 810 controls the stopper driver circuit 853 to open the lowermost stopper 452 to supply the second pucks 20 (e.g., fifteen second pucks 20) to the field board 210 (step S306).

When all of the second pucks 20 retained by the lowermost stopper 452 have been supplied to the field board 210, the main control circuit 810 closes the lowermost stopper 452, and controls the open state and the closed state of the remaining stoppers 452 while controlling the second elevator driver circuit 857 to sequentially load the second puck 20 into the lowermost stopper 452 and the remaining stoppers 452. The main control circuit 810 causes the timer circuit 820 to start the second measurement.

The main control circuit 810 then determines whether or not the total number of second pucks 20 that have been shot into the goal pockets 220 after the step S302 has reached. 10 within 10 seconds after the second measurement has started, based on each second puck goal counter (step S307).

When the main control circuit 810 has determined that the total number of second pucks 20 that have been shot into the goal pockets 220 after the step S302 has reached 10, the main control circuit 810 controls the stopper driver circuit 853 to open the lowermost stopper 452 to supply the second pucks 20 (e.g., fifteen second pucks 20) to the field board 210 (step S308). The step S310 is then performed.

When the main control circuit 810 has determined in the step S307 that the total number of second pucks 20 that have been shot into the goal pockets 220 after the step S302 has not reached 10 within 10 seconds after the second measurement has started, based on each second puck goal counter, the step S310 is performed.

The main control circuit 810 then controls the belt conveyer driver circuit 854 and the retention box driver circuit 855 to stop the belt conveyer 530 and the retention box 640 (step S310). The main control circuit 810 then controls the discharge roller driver circuit 851 and the air supply driver circuit 852 when a given time has elapsed to stop the discharge roller and the air supply unit. The sub-control, circuit 840 then displays the final score and a given production effect.

Score Control Process

Figure 15:
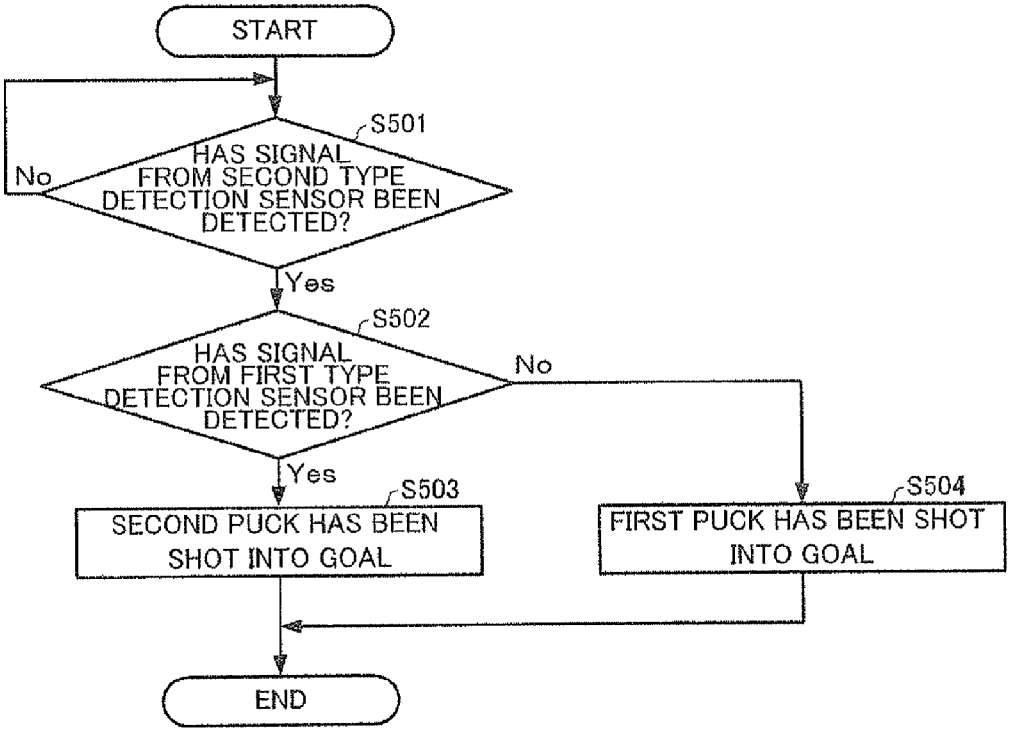
FIG. 15 is a flowchart illustrating a score control process performed by an air hockey game device according to one embodiment of the invention.

A score control process according to one embodiment of the invention is described in detail below with reference to FIG. 15. FIG. 15 is a flowchart illustrating the score control process according to one embodiment of the invention. The score control process is performed corresponding to each goal pocket 220.

When the main control circuit 810 has detected the detection signal from the second type detection sensor 522 (step S501), the main control circuit 810 determines whether or not the detection signal from the first type detection sensor 511 provided to the same transfer rail 510 has been received within a given time (step S502).

When the main control circuit 810 has determined that the detection signal from the first type detection sensor 511 has not been received within a given time in the step S502, the main control circuit 810 determines that the second puck 20 has been shot into a goal, adds points based on the second puck 20 to the latest score, and controls the sub-control circuit 840 based on the calculated score (step S503) to complete the process.

When the main control circuit 810 has determined that the detection signal from the first type detection sensor 511 has been received within a given time in the step S502, the main control circuit 810 determines that the first puck 10 has been shot into a goal, adds points based on the first puck 10 to the latest score, and controls the sub-control circuit 840 based on the calculated score (step S504) to complete the process.

Note that the first type detection sensor 511*a* and the second type detection sensor 522*a* that function as a goal detection unit are provided corresponding to the first goal pocket 220*a*, and the first type detection sensor 511*b* and the second type detection sensor 522*b* that function as a goal detection unit are provided corresponding to the second goal pocket 220*b*.

It is possible to perform the process illustrated in FIG. 15 (that detects whether or not the first puck 10 or the second puck 20 has been shot into each goal pocket (220*a*, 220*b*) corresponding to each player, and adds points to the score) and the above game process by providing the first type detection sensor (511*a*, 511*b*) and the second type detection sensor (522*a*, 522*b*) that function as a goal detection unit corresponding to each goal pocket (220*a*, 220*b*).

As described above, since the air hockey game device 100 according to one embodiment of the invention can implement the game that that allows the player to shoot the first puck 10 and the second puck 20 into a goal, it is possible to provide novel game playability by allowing the pucks that slide at a different speed to be present on the field board 210. Therefore, the air hockey game device 100 according to one embodiment of the invention can change the score (points) based on the type of puck, supply the second puck in order to change the game playability during the normal game that utilizes the first puck, and throw the players into a panic to implement an exciting game.

Since the air hockey game device 100 according to one embodiment of the invention can control the process of the game based on the type of puck, it is possible to attach importance to game strategy rather than the skill of operating the mallet 50 for controlling a single game medium by allowing a plurality of different game media to be present on the field board 210.

This makes it possible to allow the players to enjoy the game even when the players differ in skill.

Since the second pucks 20 are placed side by side on the slope, and loaded, the second pucks 20 can be slidably supplied to the field board 210 while preventing a situation in which the second puck 20 that has reached the surface of the field board overlaps another second puck 20, and the second pucks 20 can be caused to appear on the field board 210 in a sliding manner.

Since the angular difference with respect to the surface of the field board in the horizontal direction can be reduced by setting the supply angle of the second puck 20 to be smaller than the slope angle of the slope, the second puck 20 can be smoothly supplied to the field board 210.

Since the stopper 452 can be set from the closed state to the open state when a given condition has been satisfied, a plurality of second pucks 20 can be simultaneously supplied to the surface of the field board by controlling the stopper 452 corresponding to the process of the game (e.g., when one of the players has continuously lost the game, when a predetermined difference in score has been reached, or when a given time has elapsed).

Therefore, it is possible to simplify the structure of the supply unit 400, and change the game playability during the game to implement an exciting game.

The air hockey game device 100 according to one embodiment of the invention can appropriately load the collected first puck 10 and the collected second puck 20 into the supply unit 400 corresponding to the type of puck.

The loading unit 600 can be used as a mechanism for retaining the first puck 10 that is simultaneously used in a small number by adjusting the moving timing of the first elevator 650 from the position under the field board to the supply unit 400, and the second puck 20 that is simultaneously used in a large number can be retained using the retention box 640.

This makes it possible to smoothly collect and load the pucks even when a large number of second pucks 20 are used, and supply a sufficient number of second pucks 20 to the field board 210 by preventing a short supply to the supply unit 400. The air hockey game device 100 according to one embodiment of the invention can appropriately load the second puck 20, and simultaneously and appropriately supply a predetermined number of second pucks 20 to the field board 210.

Since the first puck 10 can be automatically supplied to the field board 210, and the balance of the game can be maintained by supplying the first puck 10 to the player who has conceded a goal, it is possible to provide an exciting game.

Since each puck has such a disc-like shape, and force can be easily transmitted when the puck has been struck, or has collided with the wall member of the field board 210, the puck can slide on the field board 210 at a high speed, and the player can experience exhilaration.

Since the second puck 20 has a size smaller than that of the first puck 10, the player can visually determine the type of puck. Since the first puck 10 and the second puck 20 slide at a different speed even when struck at an identical force, the player can visually enjoy the game, and the game playability can be changed by utilizing different pucks.

Since a state in which the first puck 10 has been shot into a goal can be detected by both the first type detection sensor 511 and the second type detection sensor 522, and a state in which the second puck 20 10 has been shot into a goal can be detected by only the second type detection sensor 522, the type of puck can be determined although the pucks are transferred along an identical transfer path.

Therefore, the air hockey game device 100 according to one embodiment of the invention can control the process of the game (e.g., controlling the supply timing of the second puck 20, or calculating the score using a different puck) based on the type of puck.

Since the collected puck can be transferred from a lower position to a higher position, and the puck is not transferred in a state in which a plurality of pucks overlaps, the pucks can be transferred separately.

Moreover, a plurality of pucks that overlaps each other can be separated by the discharge roller 224, and a situation in which a plurality of pucks is discharged at one time can be prevented.

The air hockey game device 100 according to one embodiment of the invention can also control the process of the game (e.g., adding different points to the score depending on whether the puck is the first puck 10 or the second puck 20, or adjusting the points based on the timing at which the first puck 10 or the second puck 20 has entered the goal pocket 220) based on the type of puck.

Modifications

Modifications of the above embodiments are described below.

In the above embodiments, an opaque cover provided with a transparent area may be disposed opposite to the slope member 410 instead of the transparent cover 430 so that only some of a plurality of second pucks 20 retained in the lower part of the second supply section 450 can be observed.

In this case, since the players cannot determine the number of second pucks 20 to be supplied, it is possible to throw the players into a panic when supplying the second pucks 20, and prevent the players losing interest in the game.

The first supply section 440 and the second supply section 450 of the supply unit 400 may be formed on slope members that are provided independently.

Although the above embodiments have been described taking an example in which a plurality of second pucks 20 is simultaneously supplied to the field board 210, a plurality of second pucks 20 may be arranged linearly in the slope direction, and sequentially supplied to the field board 210 when a given condition has been satisfied. In this case, the supply direction may be changed based on a given condition, and the plurality of second pucks 20 may be supplied toward one of the goal pockets 220 in the same manner as the first supply section 440 that supplies the first puck 10.

Although the above embodiments have been described taking an example in which a predetermined number (e.g., one set or two sets) of second pucks 20 are supplied to the field board 210 under control of the drive control unit 800, the number of second pucks 20 to be supplied may be changed randomly.

Although the above embodiments have been described taking an example in which the second puck 20 is supplied to the field board 210 under control of the drive control unit 800 corresponding to the game situation, the second puck 20 may be supplied at a given timing after the air hockey game has started, independently of control of the drive control unit 800.

The air hockey game device according to the embodiments of the invention may be applied as an arcade game device that is installed in play facilities (e.g., video arcade), or may be applied as a consumer game device.

REFERENCE SIGNS LIST

10 First puck
20 Second puck
100 Air hockey game device
200 Housing
210 Field board
211 Air hole
220 Goal pocket
221 Opening
222 Receiving section
223 Outlet
224 Discharge roller
230 Wall
300 Air supply unit
400 Supply unit
410 Slope member
420 Supply guide member
430 Transparent cover
440 First supply section
441 Independent path
442 Switch path
443 Path switch movable member
444 Restriction member
450 Second supply section
451 Second puck loading sensor
452 Stopper
500 Collection/transfer unit
510 Transfer rail
511 First type detection sensor
522 Second type detection sensor
520 Collection box
530 Belt conveyer
531 Protrusion member
600 Loading unit
610 First slider
620 Second slider
630 Puck sort-out rail
631 Elliptical hole
640 Retention box
650 First elevator
660 Second elevator
700 Notification unit
710 Liquid crystal display
720 Speaker
800 Drive control unit
810 Math control circuit
820 Timer circuit
830 Counter circuit
840 Sub-control circuit
851 Discharge roller driver circuit
852 Air supply driver circuit
853 Stopper driver circuit
854 Belt conveyer driver circuit
855 Retention box driver circuit
856 First elevator driver circuit
857 Second elevator driver circuit
858 Switch control circuit
860 Coin insertion sensor

The invention claimed is:

1. A game device that implements a game that allows a plurality of players to strike a game medium using a striking device to shoot the game medium into a goal of an opponent player, the game device comprising:

a field board that includes a sliding surface, and a wall member that is provided around the sliding surface, the game medium sliding on the sliding surface;

a plurality of goal pockets that functions as the goal, each of the plurality of goal pockets including an opening that is formed in the field board, and receiving the game medium;

a supply unit that supplies a first game medium and a second game medium to the field board corresponding to a game situation, the second game medium differing in size from the first game medium, the supply unit including:

a first supply section configured to slidably supply the first game medium singly to the field board, and a second supply section configured to slidably supply a plurality of the second game medium to the field hoard; and a processor programmed to control the supply unit to selectively supply at least one of the first game medium and the second game medium, and control a process of the game corresponding to the size of game medium supplied.

2. The game device as defined in claim 1, wherein the second supply section slidably supplies the plurality of second game mediums simultaneously to the field board when the game is being played using the first game medium, and a given condition has been satisfied.

3. The game device as defined in claim 2, wherein the second supply section is formed on a slope member that has a slope formed at a given slope angle with respect to a surface of the field board, the second supply section: (i) retaining the plurality of second game mediums in a state in which the plurality of second game mediums are placed side by side in a direction that intersects a slope direction of the slope, and (ii) slidably supplying the plurality of second game mediums to the field hoard by allowing the plurality of second game mediums retained therein to slide along the slope due to gravity.

4. The game device as defined in claim 3, wherein the second supply section includes a supply guide member that is formed integrally with the slope, and slidably supplies the second game medium to the field board while sliding the second game medium, and a supply angle when the second game medium is supplied by the supply guide member is smaller than the slope angle of the slope.

5. The game device as defined in claim 3, wherein the second supply section further includes a stopper that is provided at a given position on the slope, the stopper maintaining a retention state of the plurality of second game mediums in a closed state, and slidably supplying the plurality of second game mediums to the field board in an open state by allowing the plurality of second game mediums retained in the second supply section to slide along the slope due to gravity, and the game control unit sets the stopper from the closed state to the open state when a given condition has been satisfied.

6. The game device as defined in claim 1, further comprising:

a loading unit that transfers the first game medium and the second game medium that have entered the goal pocket in a mixed state and have been collected under the field board to the supply unit using different elevator mechanisms corresponding to a type of game medium, and loads the first game medium and the second game medium into the supply unit.

7. The game device as defined in claim 6, wherein the loading unit includes a retention section that selectively retains the second game medium that has been collected together with the first game medium in a mixed state, the loading unit supplying the collected first game medium to the supply unit using the elevator mechanism, and supplying the retained second game medium to the supply unit using the elevator mechanism.

8. The game device as defined in claim 1, wherein the first game medium and the second game medium have a disc-like shape.

9. The game device as defined in claim 1, further comprising:

a collection/transfer mechanism that collects a plurality of game mediums that differs in size and has entered the goal pocket in a mixed state, and transfers the plurality of game mediums that has been collected to the supply unit, wherein the collection/transfer mechanism includes a transfer unit that sequentially transfers the plurality of game mediums from a first transfer point to a second transfer point that is higher than the first transfer point, and a plurality of protrusion members is formed at given intervals on an upper side of the transfer unit on which the game medium is placed, the plurality of protrusion members preventing the game medium placed on the upper side of the transfer unit from falling down in an upstream direction, and having a height equal to or larger than a thickness of each of the plurality of game mediums.

* * * * *